US008507814B2

(12) United States Patent
De France et al.

(10) Patent No.: US 8,507,814 B2
(45) Date of Patent: Aug. 13, 2013

(54) RESISTANCE DEVICE FOR HIGH VOLTAGE SWITCH ASSEMBLY

(75) Inventors: Robert Victor De France, Poughkeepsie, NY (US); Daniel David Dobrinski, Hillsboro, NH (US)

(73) Assignee: Hubbell Incorporated, Shelton, CT (US)

( * ) Notice: Subject to any disclaimer, the term of this patent is extended or adjusted under 35 U.S.C. 154(b) by 336 days.

(21) Appl. No.: 13/006,908

(22) Filed: Jan. 14, 2011

(65) Prior Publication Data

US 2011/0214970 A1 Sep. 8, 2011

Related U.S. Application Data

(60) Provisional application No. 61/309,772, filed on Mar. 2, 2010.

(51) Int. Cl.
*H01H 1/00* (2006.01)

(52) U.S. Cl.
USPC ..... 200/274

(58) Field of Classification Search
USPC ..... 200/274, 48 A, 48 SB, 48 R, 48 CB, 200/48 KB, 49, 554, 558; 218/2, 7, 9, 12, 218/14, 20, 21, 153, 154; 338/215
See application file for complete search history.

(56) References Cited

U.S. PATENT DOCUMENTS

| | | | | |
|---|---|---|---|---|
| 2,272,370 | A | 2/1942 | Fox | |
| 2,626,332 | A | 1/1953 | Earle et al. | |
| 2,866,048 | A | 12/1958 | Hulteen et al. | |
| 3,646,288 | A | 2/1972 | Perry et al. | |
| 4,078,162 | A | 3/1978 | Turner | |
| 5,270,500 | A * | 12/1993 | Guiney | 200/17 R |
| 5,986,225 | A | 11/1999 | Castonguay et al. | |
| 6,541,717 | B1 * | 4/2003 | Roberts | 200/43.11 |
| 6,946,607 | B2 | 9/2005 | Roberts | |
| 2008/0026644 | A1 * | 1/2008 | De France et al. | 439/783 |
| 2010/0006414 | A1 * | 1/2010 | De France | 200/554 |

* cited by examiner

*Primary Examiner* — Edwin A. Leon
(74) *Attorney, Agent, or Firm* — Marcus R. Mickney; Mark S. Bicks; Alfred N. Goodman

(57) ABSTRACT

A resistance device for an electrical switch assembly includes a housing having a base and first and second support brackets extending outwardly therefrom. The base receives first and second conductive blades of the electrical switch assembly. A cam member is movably connected to the first and second supporting brackets. First and second spring members are connected between the base and the cam member and bias the cam member away from the base. The amount of force required to open and close the switch assembly is increased by having to overcome the resistance force imparted by the first and second spring members on the cam member during rotation of the conductive blades.

20 Claims, 26 Drawing Sheets

RESISTANCE DEVICE FOR HIGH VOLTAGE SWITCH ASSEMBLY

CROSS-REFERENCE TO RELATED APPLICATION

This application claims the benefit under 35 U.S.C. §119 (e) of provisional application Ser. No. 61/309,772, filed Mar. 2, 2010, the entire disclosure of which is hereby incorporated by reference.

FIELD OF THE INVENTION

The present invention relates generally to a resistance device for a high voltage switch assembly. More particularly, the present invention relates to a resistance device that prevents accidental closure of the switch assembly from a fully opened position. Still more particularly, the present invention relates to a switch assembly having a resistance device that increases the amount of force required to open and close the switch assembly.

BACKGROUND OF THE INVENTION

Currently, many high voltage switch assemblies for overhead power distribution lines are opened and closed by a field technician using a hookstick. The hookstick engages conductive switch blades electrically and mechanically connected between conductors of an electrical power distribution system. Manipulating the hook rotates the switch blades between closed and open positions.

High voltage overhead power switches are typically mounted well above ground and experience a variety of externally applied forces, such as weather, wild animals, vandalism, utility pole deformation, and vibration, which may cause a switch blade to move or close unintentionally. Accidental closing of a switch blade may cause equipment damage, loss of electrical service and personnel injury. Furthermore, if a switch blade moves close enough to a contact, flashover may occur. The conductive switch blades must be prevented from unintended closing or movement thereof from the open position. Therefore, a need exists for an overhead switch assembly having a resistance device to prevent accidental closing or movement of the conductive switch blades from the open position.

SUMMARY OF THE INVENTION

In accordance with an aspect of the present invention, a need exists for a resistance device for a high voltage switch assembly that prevents closing or movement of conductive switch blades from an open position.

In accordance with another aspect of the present invention, the resistance device increases the force required to move the blades from the fully opened position.

A resistance device for a high voltage electrical switch assembly according to an exemplary embodiment of the present invention increases the amount of force required to fully open the conductive switch blades (or "knife blades"). Additionally, such additional force is required to be overcome to close the switch, thereby substantially preventing accidental closure of the switch. The force created by the resistance device is preferably greatest at approximately 115 degrees from its fully closed position.

The resistance device is disposed between the knife blades and includes a pair of spring members disposed between a cam member and a housing. An aligning pin is disposed in a slot of the cam member to allow for travel of the cam member when engaged by a mounting hinge tab connected to a mounting hinge. In a fully closed position, the cam member of the resistance device does not contact the mounting hinge tab, such that the resistance device spring members are not compressed. At approximately 115 degrees, the cam member has reached its maximum travel distance, which compresses the resistance device spring members, thereby increasing the force required to further open the knife blade. When the knife blade is fully open, the spring members are slightly less compressed then at 150 degrees from the closed position due to a shorter travel distance of the cam member by engagement with the mounting hinge tab. Accordingly, the resistance device creates an additional force that must be overcome throughout closure of the knife blade, thereby substantially preventing accidental closure of the knife blade.

The foregoing objectives are basically attained by a resistance device for an electrical switch assembly that includes a housing having a base and first and second support brackets extending outwardly therefrom. The base receives first and second blades of the electrical switch assembly. A cam member is movably connected to the first and second support brackets. First and second springs are connected between the base and the cam member and bias the cam member away from the base. The amount of force required to open and close the switch assembly is increased by having to overcome the resistance force imparted by the first and second spring members on the cam member.

The foregoing objectives are also basically attained by an electrical switch assembly including a mounting hinge and first and second conductive blades rotatably connected to the mounting hinge and rotatable between open and closed positions. A tab is connected to the mounting hinge. A resistance device is disposed between the first and second conductive blades. A housing has a base and first and second supporting brackets extending outwardly therefrom. The base receives the first and second conductive blades of the electrical switch assembly. A cam member is movably connected to the first and second supporting brackets. First and second spring members are connected between the base and the cam member. The cam member engages the tab and compresses the first and second spring members during rotation of the first and second conductive blades between the open and closed positions to increase a force required to rotate the conductive blades. The first and second spring members bias the cam member away from the base.

The foregoing objectives are also basically attained by a method of operating an electrical switch assembly. A conductor blade is rotated about a mounting hinge from either an open or a closed position. A resistance member connected to the conductor blade is engaged with a tab connected to the mounting hinge to increase a force required to rotate the conductor blade to the closed or the open position.

Objects, advantages, and salient features of the invention will become apparent from the following detailed description, which, taken in conjunction with the annexed drawings, discloses exemplary embodiments of the invention.

As used in this application, the terms "front", "rear", "upper", "lower", "upwardly", "downwardly" and other relative orientational descriptors are intended to facilitate the description of the base assembly, and are not intended to limit the structure of the base assembly to any particular position of orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numbers will be understood to refer to like parts, components and structures.

DETAILED DESCRIPTION OF THE EXEMPLARY EMBODIMENTS

Figure 1:
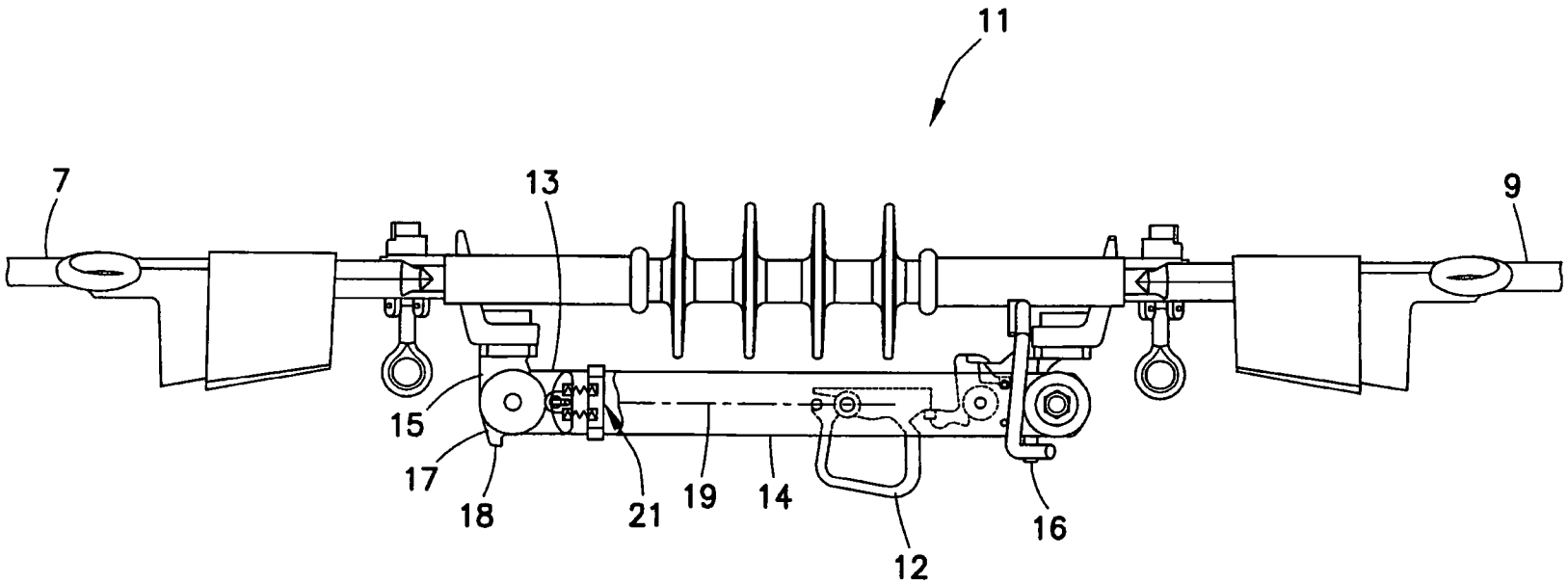
FIG. 1 is a side elevational view of a fully closed switch assembly including a resistance device according to an exemplary embodiment of the present invention.

In an exemplary embodiment of the present invention shown in FIGS. 1-19, a resistance device 21 for a high voltage electrical switch assembly 11 increases the amount of force required to fully open the conductive switch blades 13 (or "knife blades"). Such additional force is also required to be overcome to close the switch assembly 11, thereby resisting and substantially preventing accidental closure of the switch assembly.

The resistance device 21 is connected between two conductive blades 13 and 14 of the switch assembly 11, as shown in FIGS. 1-3, 18 and 19. The resistance device 21 includes a housing 31 connected to the blades 13 and 14, and a cam member 41 movably connected to the housing 31.

Figure 6:
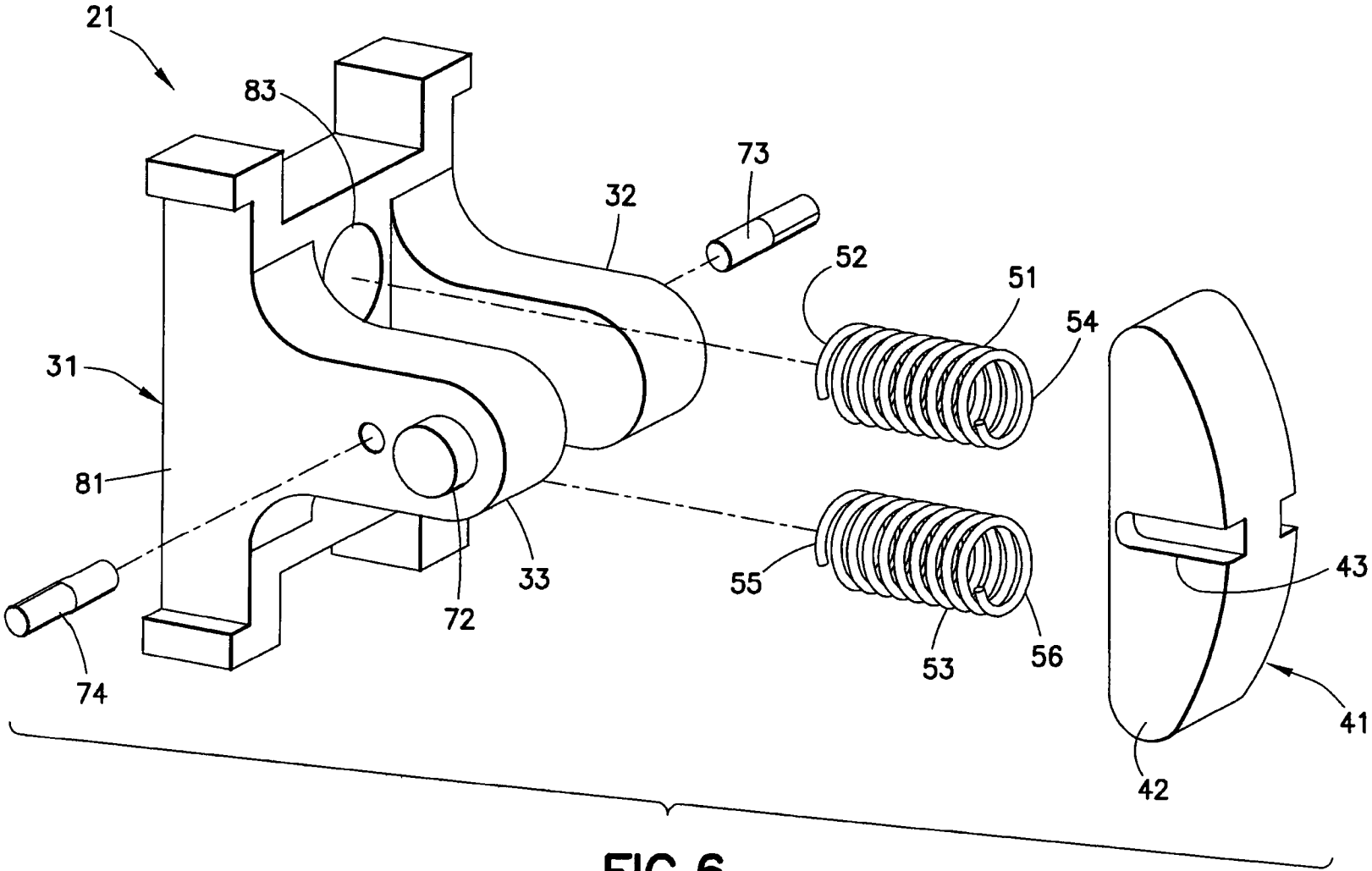
FIG. 6 is an exploded perspective view of the resistance device of FIG. 4.
Figure 7:
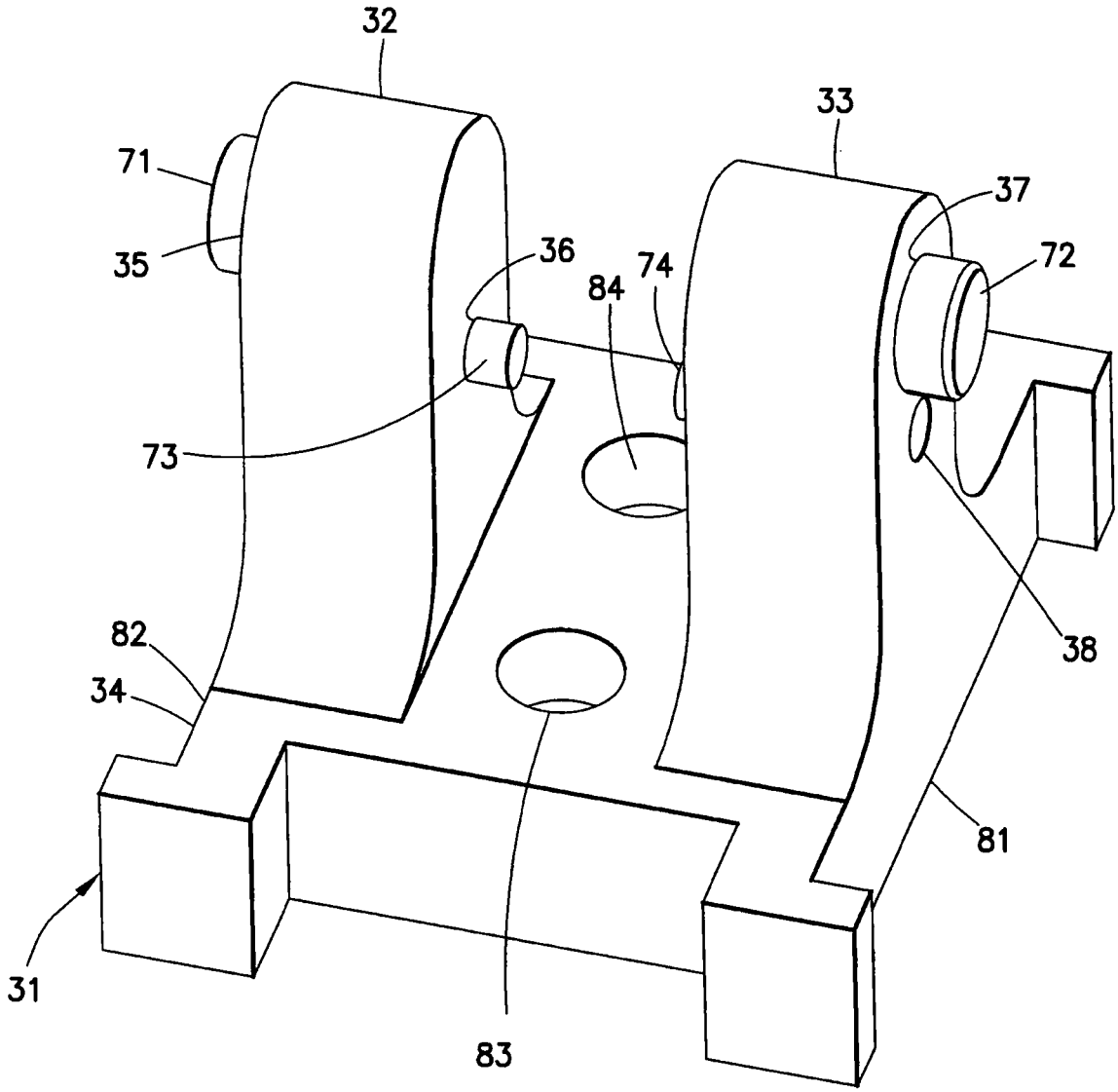
FIG. 7 is a perspective view of the housing of the resistance device of FIG. 4.
Figure 8:
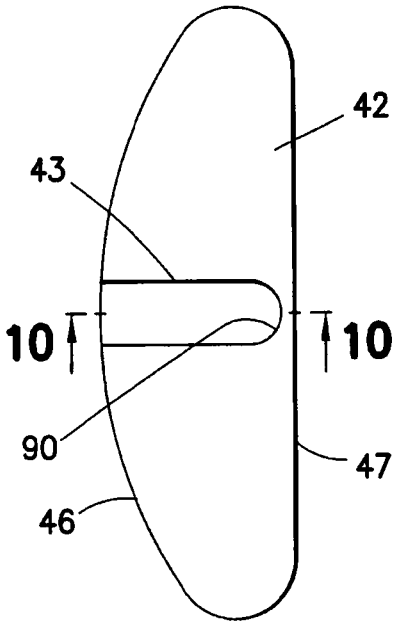
FIG. 8 is a side elevational view of the cam member of the resistance device of FIG. 6.
Figure 9:
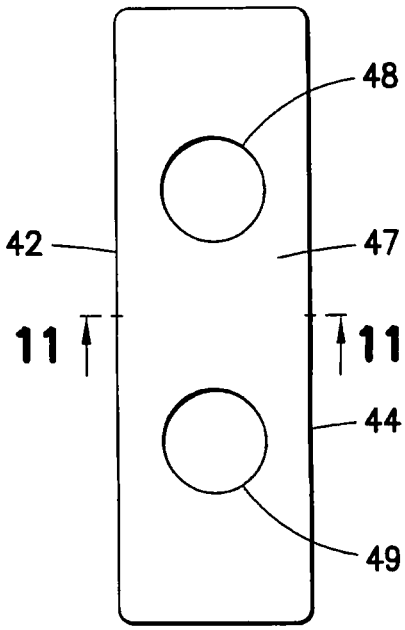
FIG. 9 is a bottom plan view of the cam member of the resistance device of FIG. 6.

The housing 31, as shown in FIGS. 7 and 13-17, has first and second supporting brackets 32 and 33 extending upwardly from a base 34. Preferably, the housing 31 has retaining pins 71 and 72 that are unitarily formed with the housing as one-piece members thereof. Alternatively, each of the first supporting bracket 32 and the second supporting bracket 33 has a first opening 35 and 37 for receiving the retaining pins 71 and 72, such as by press-fit, for securing the housing to the blades 13 and 14. Preferably, the first openings 35 and 37 do not extend entirely through the first and second supporting brackets 32 and 33, as shown in FIGS. 6 and 7. Each of the first and second supporting brackets 32 and 33 has a second opening 36 and 38 for receiving aligning pins, such as by press-fit, for engaging the cam member 41. As shown in FIGS. 6 and 7, the second openings 36 and 38 preferably extend entirely through the first and second supporting brackets 32 and 33, respectively.

A first groove 81 is formed in the base 34 of the housing 31 and is adapted to receive a blade 14. A second groove 82 is formed in the base 34 and is adapted to receive the other blade 13. The grooves 81 and 82 in the base 34 and the retaining pins 71 and 72 facilitate rigidly connecting the housing 31 to blades 13 and 14, and substantially prevent movement of the housing during operation of the blades. A first opening 83 and a second opening 84 are disposed in the base 34 and receive the first and second spring members 51 and 53, respectively.

Figure 10:
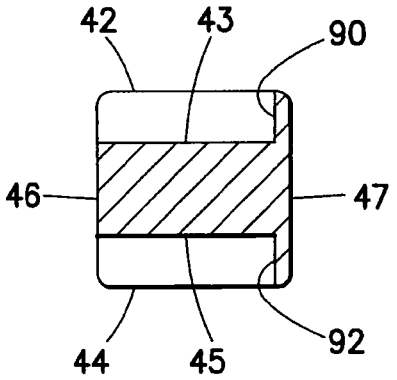
FIG. 10 is an end elevational view in cross section of the cam member of the resistance device of FIG. 6 taken along line 10-10 of FIG. 8.
Figure 11:
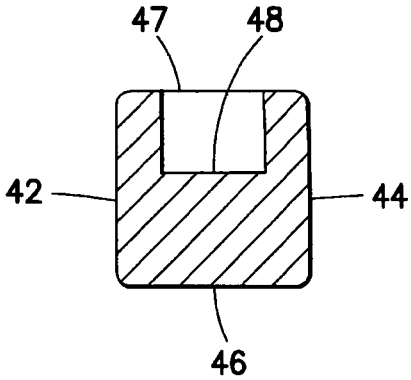
FIG. 11 is an end elevational view in cross section of the cam member of the resistance device of FIG. 6 taken along line 11-11 of FIG. 9.
Figure 13:
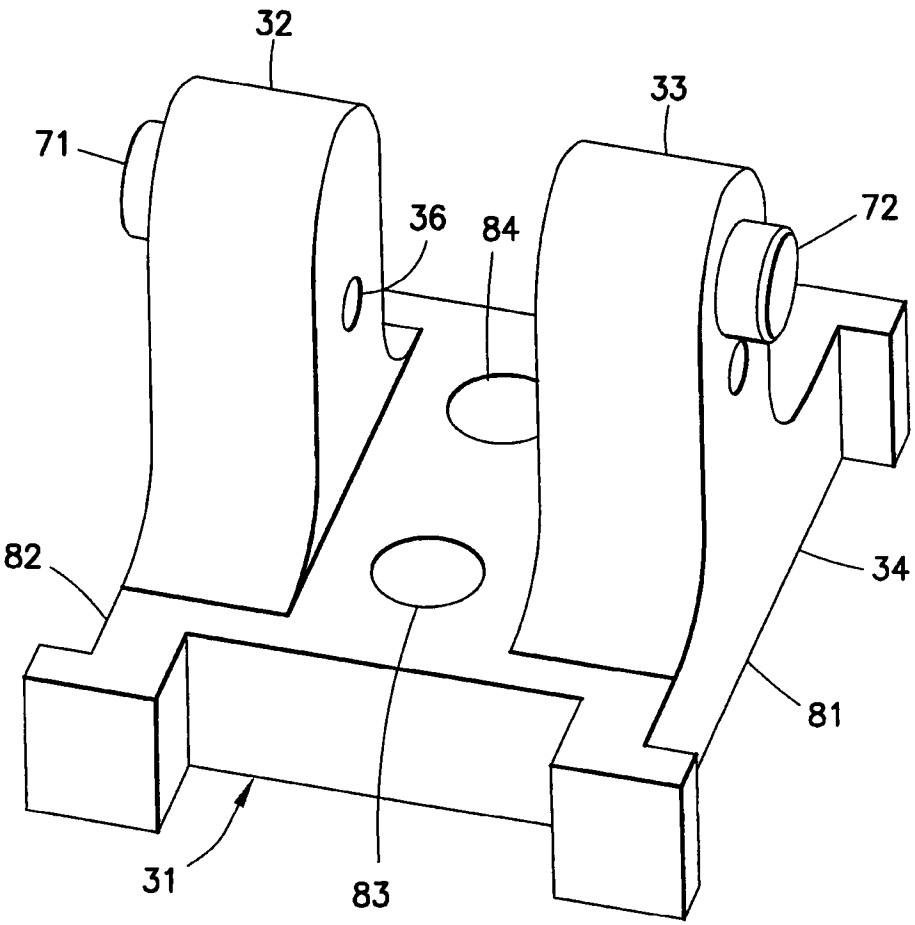
FIG. 13 is a perspective view of the housing of the resistance device of FIG. 6.
Figure 12:
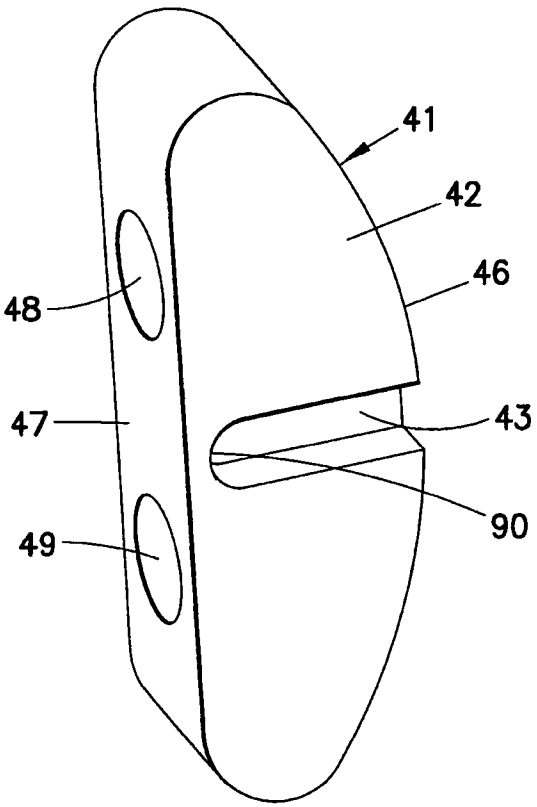
FIG. 12 is a perspective view of the cam member of the resistance device of FIG. 6.
Figure 14:
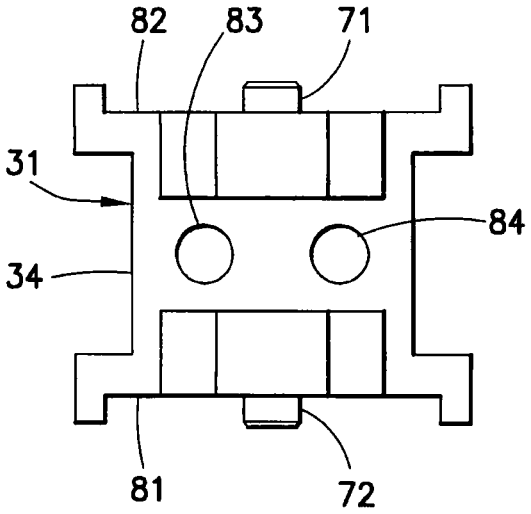
FIG. 14 is a top plan view of the housing of FIG. 13.
Figure 15:
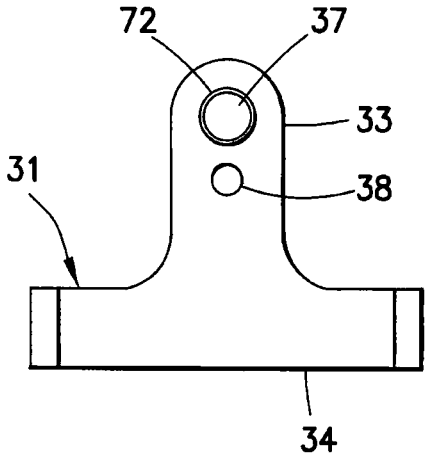
FIG. 15 is a side elevational view of the housing of FIG. 13.
Figure 16:
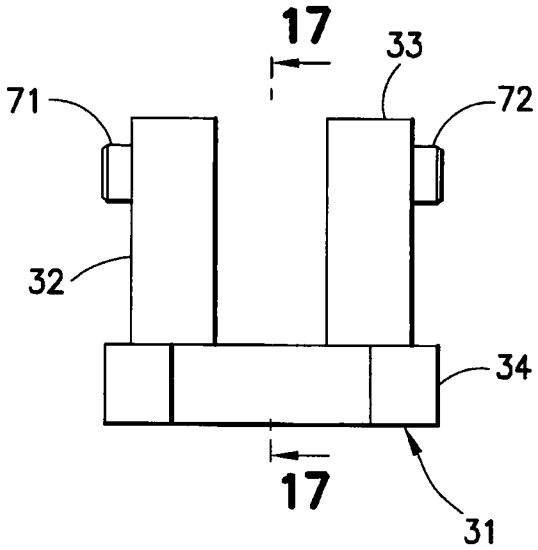
FIG. 16 is a front elevational view of the housing of FIG. 13.
Figure 17:
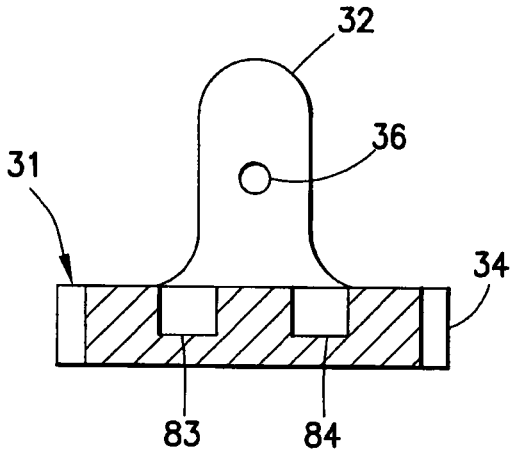
FIG. 17 is a side elevational view in cross section of the housing of FIG. 13 taken along line 17-17 of FIG. 16.
Figure 18:
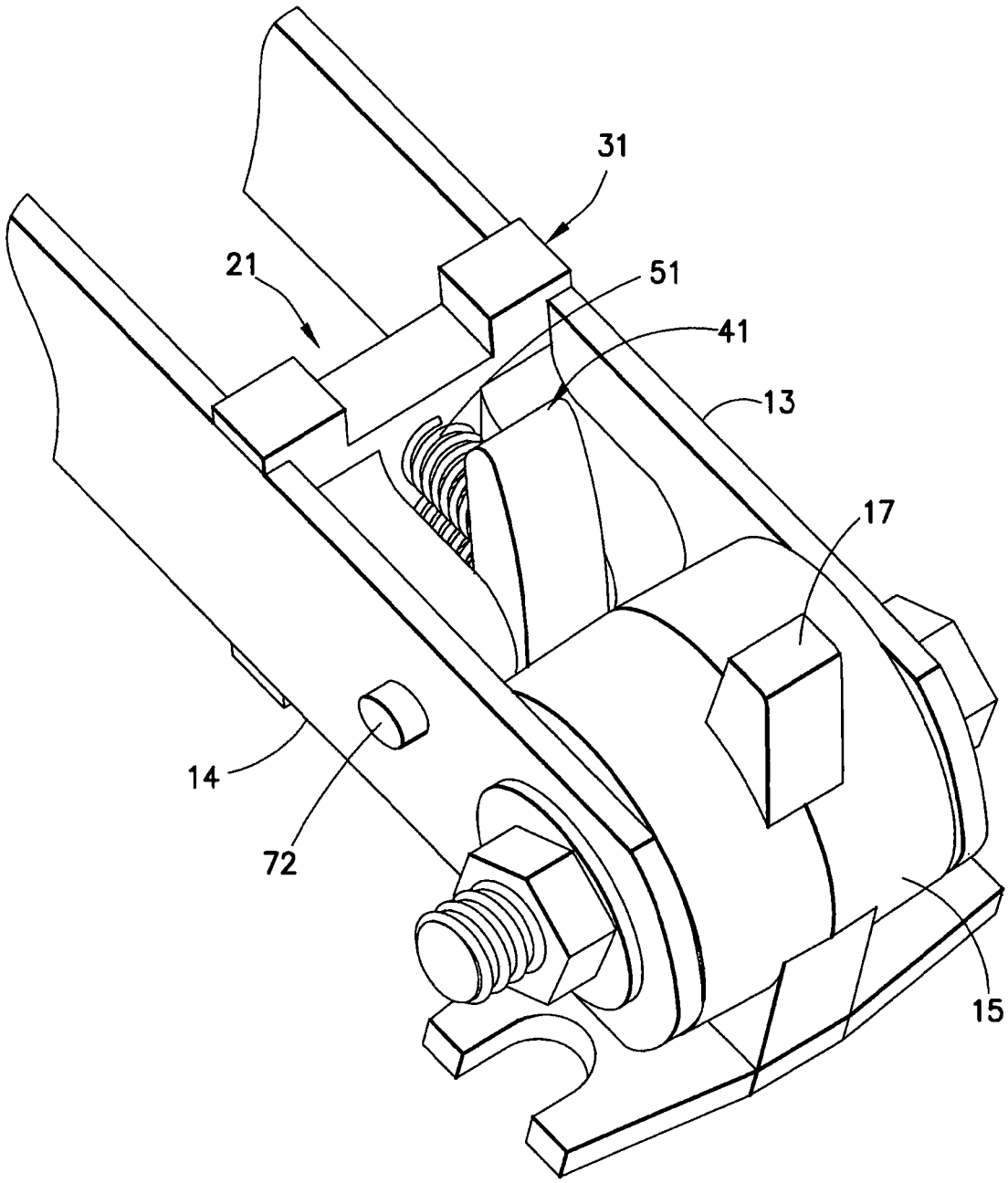
FIGS. 18 and 19 are perspective views of the resistance device disposed between conductive blades of a switch assembly.
Figure 19:
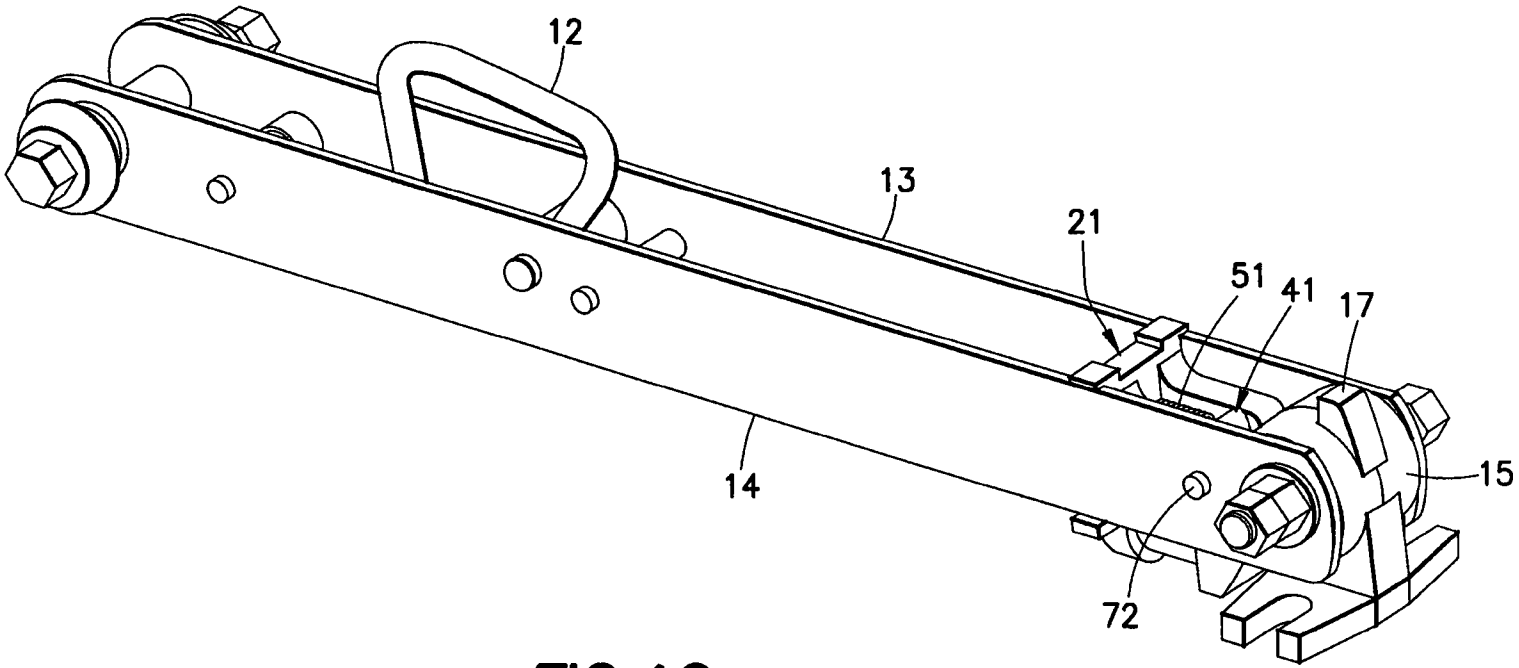

The cam member 41, as shown in FIGS. 6 and 8-12 is movably connected between the two base members 32 and 33 of the housing 31. The cam member 41 has a first surface 42 having a first groove 43 and a second surface 44 having a second groove 45. The first and second grooves 43 and 45 receive the second and first aligning pins 74 and 73, respectively. An upper surface 46 and a lower surface 47 are defined between the first and second surfaces 42 and 44. The first and second grooves 43 and 45 preferably extend from the upper surface 46 of the cam member 41 and end above the lower surface 47, as shown in FIG. 10. Preferably, the upper surface 46 is a convex surface, as shown in FIG. 12. A first opening 48 and a second opening 49 are disposed in the lower surface 47 and receive the first and second spring members 51 and 53, respectively.

Figure 4:
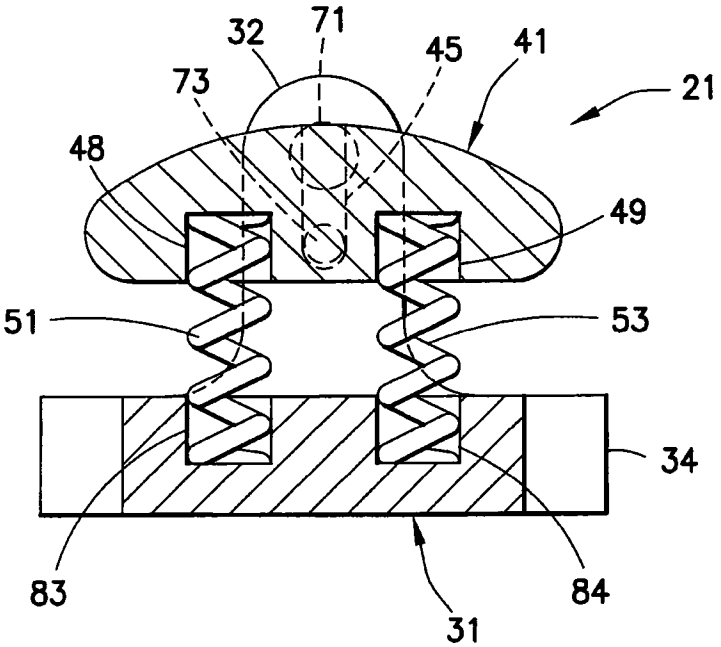
FIG. 4 is a side elevational view of the resistance device of the switch assembly of FIG. 1 in an uncompressed position.

As shown in FIG. 4, the first openings 35 and 37 receiving the retaining pins 71 and 72 are preferably centered on a longitudinal axis of the grooves 43 and 45.

The first spring member 51 has a first end 52 disposed in the first opening 83 in the base 34 of the housing 31. A second end 54 of the first spring member 51 is received in the first opening 48 in the cam member 41. The second spring member 53 has a first end 55 disposed in the second opening 84 in the base 34 of the housing 31. A second end 56 of the second spring member 53 is received in the second opening 49 in the cam member 41. The first and second spring members 51 and 53 allow the cam member 41 to move with respect to the housing 31 and bias the cam member away from the base 34 of the housing 31. The aligning pins 73 and 74 received in the grooves 45 and 43 of the cam member 41 guide movement of the cam member 41 with respect to the housing 31. Preferably, the first and second spring members are coil springs.

Preferably, the housing 31 and the cam member 41 are made of stainless steel.

Assembly and Operation

Figure 2:
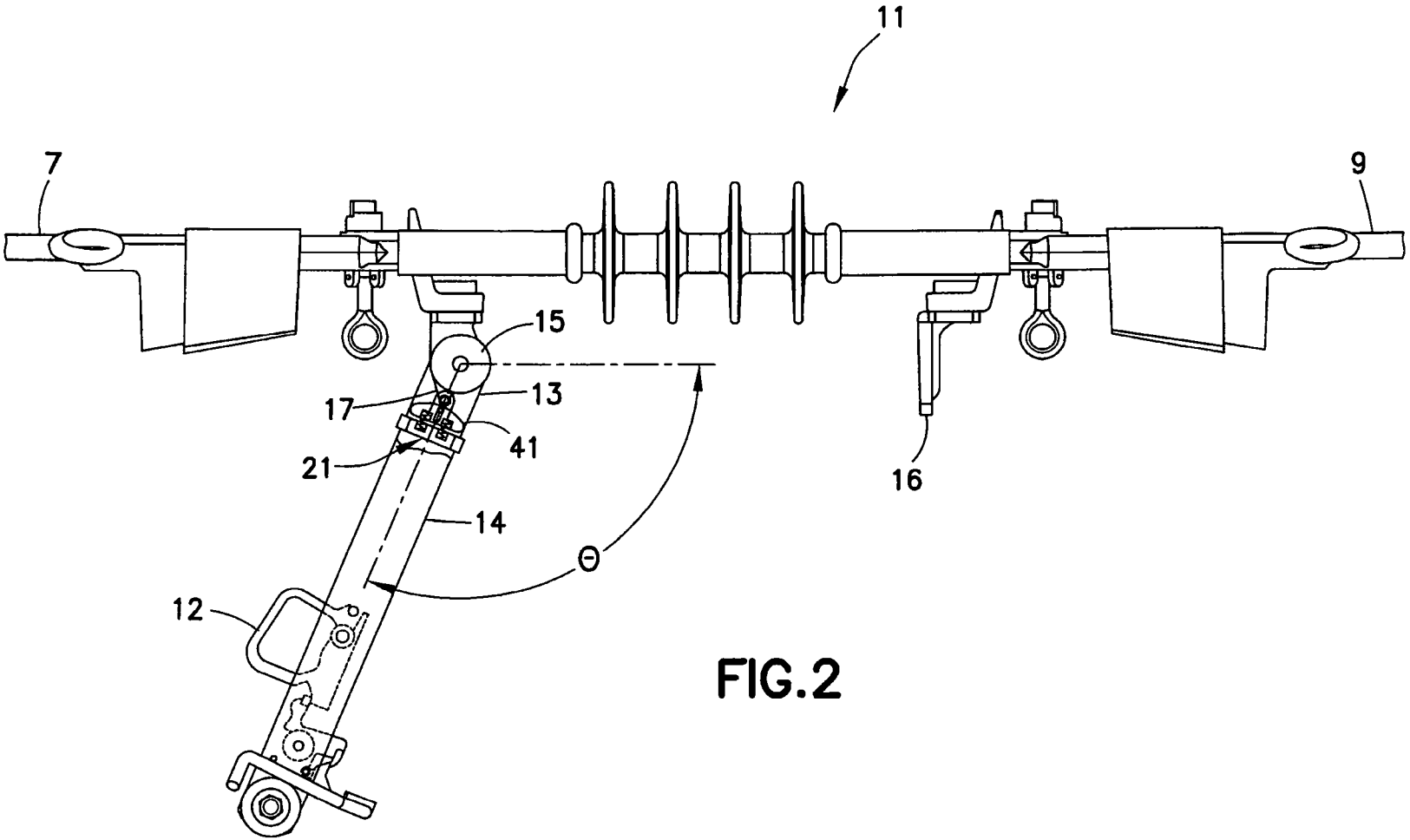
FIG. 2 is a side elevational view of the switch assembly of FIG. 1 in a partially opened position.
Figure 3:
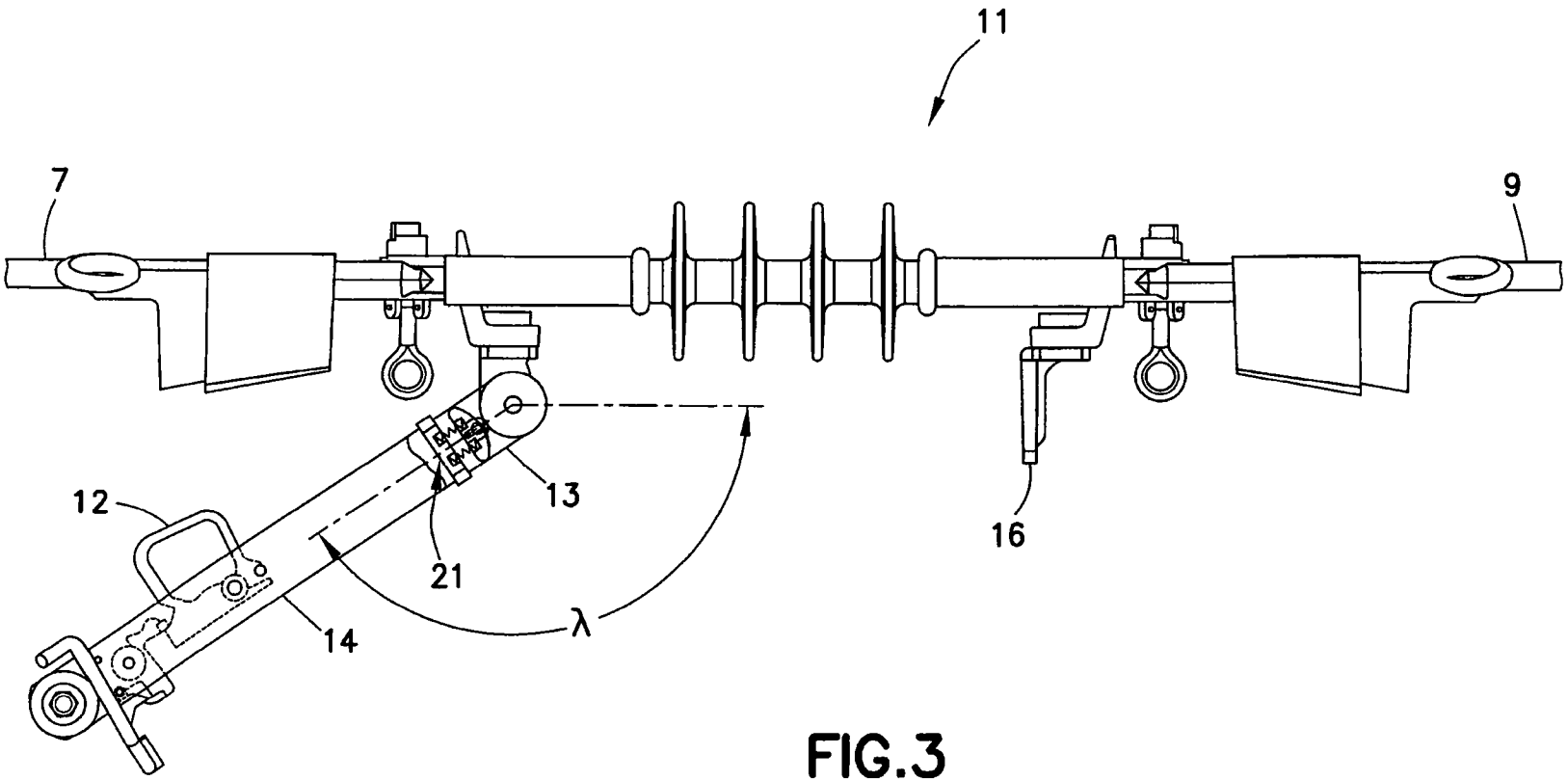
FIG. 3 is a side elevational view of the switch assembly of FIG. 1 in a fully opened position.

The resistance assembly 21 according to the exemplary embodiments of the present invention is used with a hookstick operated high voltage switch assembly 11, as shown in FIGS. 1-3. The switch assembly 11 is electrically and mechanically connected between a first conductor 7 and a second conductor 9. As shown in FIG. 1, the switch assembly 11 is in a fully closed position such that the transfer of electrical power between the first and second conductor is uninterrupted. As shown in FIG. 3, the switch assembly is a fully opened position such that the transfer of electrical power between the first and second conductor is interrupted therebetween.

A hookstick 12 is connected between the first and second conductive blades 13 and 14 of the switch assembly 11. First ends of the first and second conductive blades 13 and 14 are rotatably connected to a mounting hinge 15 of the switch assembly. Second ends of the first and second conductive blades 13 and 14 are removably connected to a terminal 16.

The resistance device 21 is connected between the first and second conductive blades 13 and 14, as shown in FIGS. 1-3, 18 and 19. Retaining pins 71 and 72 are connected to the blades 13 and 14 such that the retaining pins 71 and 72 are disposed on a center line or longitudinal axis 19 of the blades, as shown in FIG. 1. Accordingly, the cam member grooves 43 and 45 are aligned with the center line 19 of the blades.

When the first and second conductive blades 13 and 14 are in the fully closed position, as shown in FIG. 1, the resistance device 21 is in an uncompressed position, as shown in FIG. 4. The aligning pins 73 and 74 are proximal the bottom of the grooves 45 and 43, and the springs 51 and 53 are in an uncompressed position.

Figure 5:
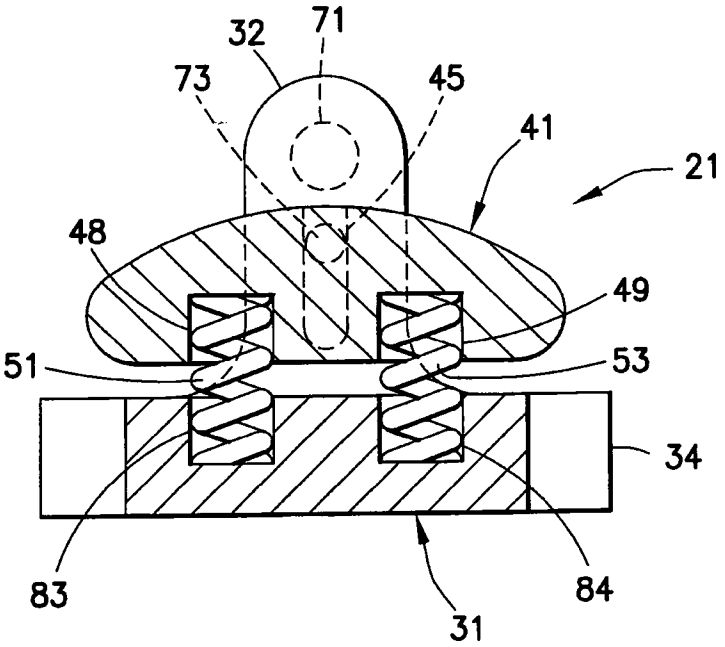
FIG. 5 is a side elevational view of the resistance device of the switch assembly of FIG. 1 in a compressed position.

Pulling on the hookstick 12 to move the blades 13 and 14 in the clockwise direction removes the second ends of the blades from the terminal 16 and rotates the first ends around the mounting hinge 15, as shown in FIG. 2. As the blades 13 and 14 are further rotated clockwise, the cam member 41 begins to abut a mounting hinge tab 17 connected to the mounting hinge 15. The mounting hinge tab 17 pushes on the upper surface 46 of the cam member 41, thereby moving the cam member 41 toward the base 34 of the housing 31 against a resistance force imparted by the spring members 51 and 53. Additional force is required to overcome the resistance force of the spring members 51 and 53 on the cam member 41 to continue opening the blades 13 and 14 due to the engagement between the cam member 41 and the mounting hinge tab 17. When the cam member 41 engages the mounting hinge tab 17, the cam member 41 is pushed toward the base 31. As the cam member 41 continues to engage the mounting hinge tab 17, the spring members 51 and 53 continue to impart a resistance force on the cam member 41 resisting the movement of the cam member 41 toward the base 31. The movement of the cam member 41 with respect to the housing 31 is guided by the grooves 45 and 43 that receive the aligning pins 73 and 74, and also compresses the springs 51 and 53. As shown in FIGS. 2 and 5, the resistance angle $\theta$ for maximum travel of the cam member 41 is preferably attained between approximately 90 and 120 degrees inclusive, and preferably at approximately 115 degrees from the fully closed position.

The hookstick 12 is further pulled to move the blades 13 and 14 to a fully opened position at the lock-open angle $\lambda$, which is preferably between approximately 130 to 175 degrees inclusive, and preferably at approximately 150 degrees from the fully closed position, as shown in FIG. 3. In the fully opened position, the cam member 41 has passed the apex 18 of the mounting hinge tab 17. The cam member 41 still abuts the mounting hinge tab 17 such that the springs 51 and 53 are still slightly compressed. Accordingly, to close the blades 13 and 14, the initial force exerted by the mounting hinge tab 17 on the cam member 41 must be overcome in addition to overcoming the increased force created by moving the cam member 41 past the apex 18 of the mounting hinge tab 17 imparted by the spring members 51 and 53 on the cam member 41. Thus, the conductive blades 13 and 14 are substantially prevented from accidental closure. Extra force is required to be used by the operator on the hookstick 12 to overcome the force exerted on the cam member 41 by the mounting hinge tab 17 and to return the blades 13 and 14 to the fully closed position, as shown in FIG. 1.

The aligning pins 71 and 72 abut the ends 90 and 92 of the grooves 43 and 45, which are above the lower surface 47 of the cam member 41 as shown in FIG. 10, thereby preventing the spring members 51 and 53 from biasing the cam member 41 out of engagement with the housing 31.

Second Exemplary Embodiment

FIGS. 20-30 show a resistance device 121 according to a second exemplary embodiment of the present invention. The resistance device 121 of the second exemplary embodiment is substantially similar to the resistance device 21 of the first exemplary embodiment with the exception that the cam grooves 143 and 145 are offset from the center line of the conductive blades 113 and 114 when mounted thereto.

The resistance device 121 is connected between two conductive blades 113 and 114 of the switch assembly 111, as shown in FIGS. 23-30. The resistance device 121 includes a housing 131 connected to the blades 113 and 114, and a cam member 141 movably connected to the housing 131.

Figure 20:
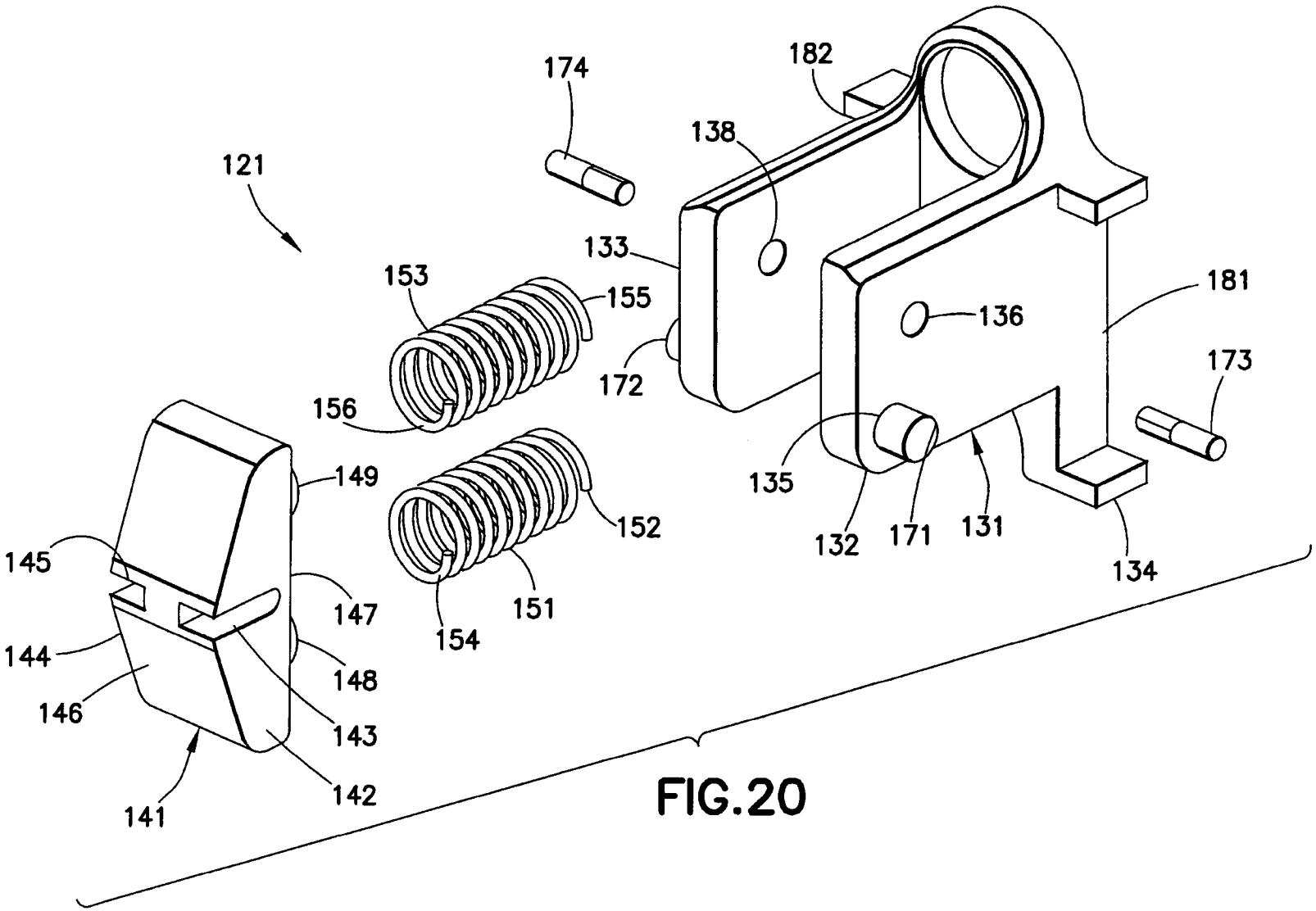
FIG. 20 is an exploded perspective view of a resistance device according to a second exemplary embodiment of the present invention.
Figure 21:
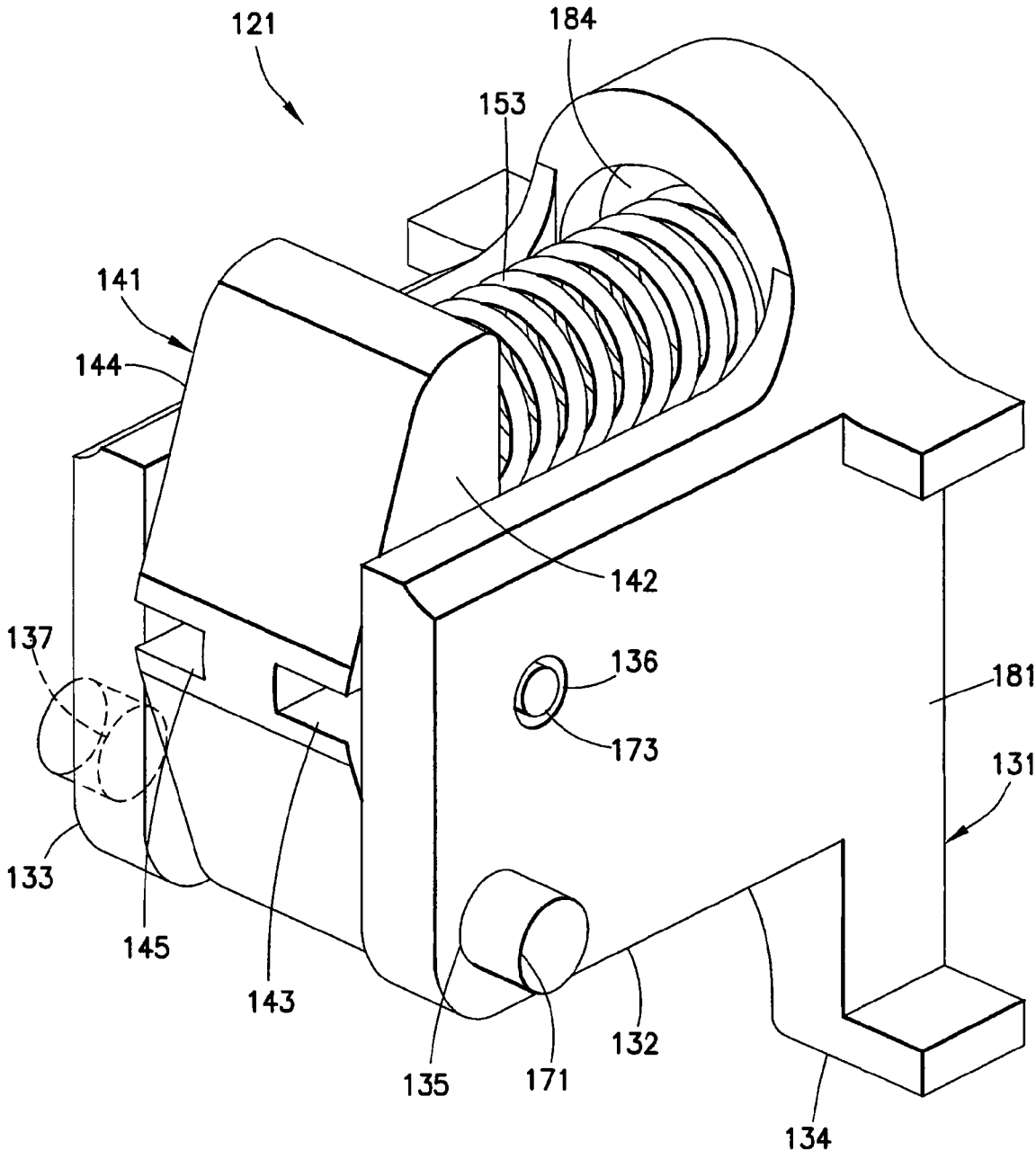
FIG. 21 is a perspective view of the resistance device of FIG. 20.

The housing 131, as shown in FIGS. 20 and 21, has first and second supporting brackets 132 and 133 extending upwardly from a base 134. Preferably, the housing 131 has retaining pins 171 and 172 that are unitarily formed with the housing as a one-piece member. Alternatively, each of the first supporting bracket 132 and the second supporting bracket 133 has a first opening 135 and 137 for receiving the retaining pins the retaining pins 171 and 172, such as by press-fit, for securing the housing to the blades 113 and 114. Preferably, the first openings 135 and 137 do not extend entirely through the first and second supporting brackets 132 and 133, as shown in FIG. 20. Each of the first and second supporting brackets 132 and 133 has a second opening 136 and 138 for receiving aligning pins 173 and 174, such as by press-fit, for engaging the cam member 141. As shown in FIG. 20, the second openings 136 and 138 preferably extend entirely through the first and second supporting brackets 132 and 133, respectively.

A first groove 181 is formed in the base 134 of the housing 131 and is adapted to receive a blade 113. A second groove 182 is formed in the base 134 and is adapted to receive the other blade 114. The grooves 181 and 182 in the base 134 and the retaining pins 171 and 172 facilitate rigidly connecting the housing 131 to the blades 113 and 114, and substantially prevent movement of the housing during operation of the blades. A first opening 183 and a second opening 184 are disposed in the base 134 and receive the first and second spring members 151 and 153, respectively.

Figure 22:
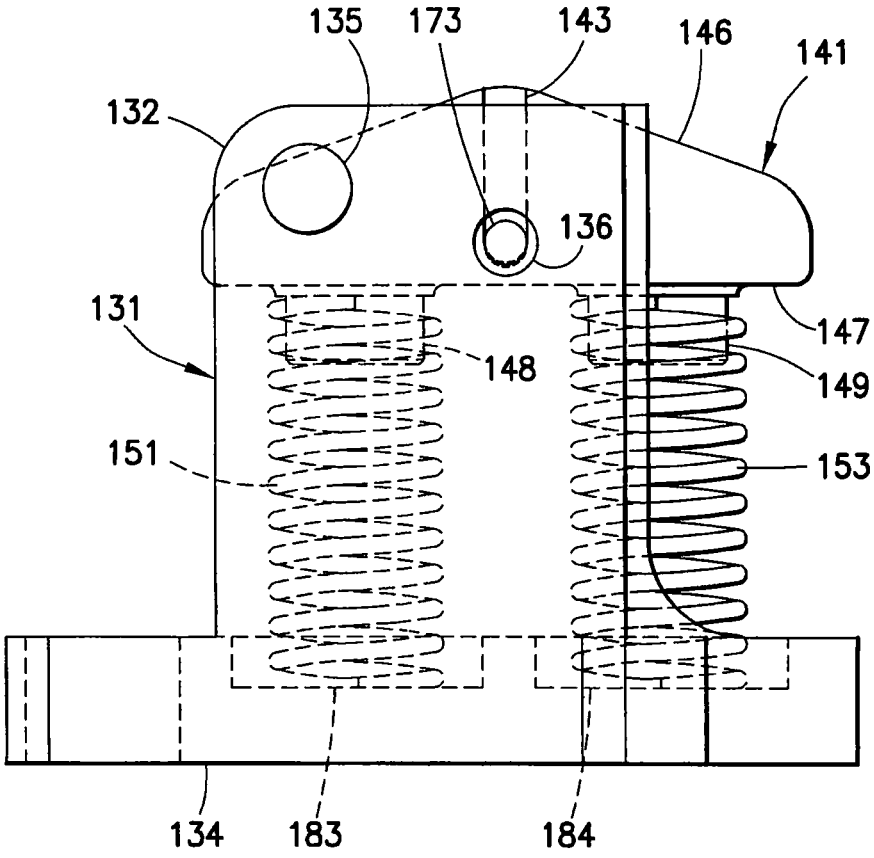
FIG. 22 is a front elevational view of the resistance device of FIG. 21.
Figure 23:
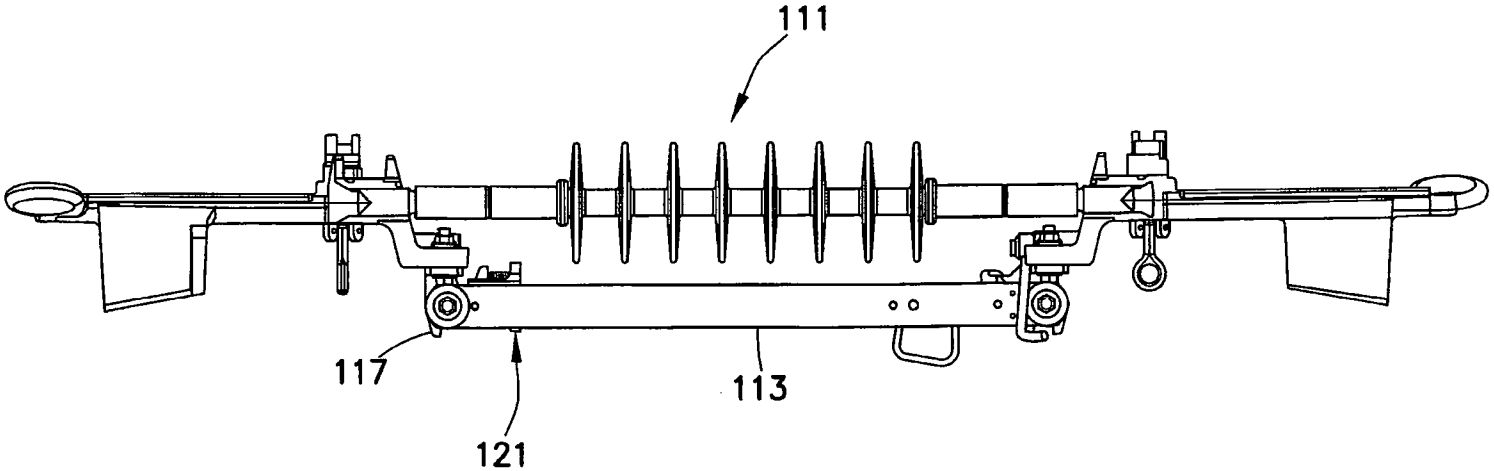
FIG. 23 is a side elevational view of a fully closed switch assembly including a resistance device according to a second exemplary embodiment of the present invention.

The cam member 141, as shown in FIGS. 20 and 21 is movably connected between the two base members 132 and 133 of the housing 131. The cam member 141 has a first surface 142 having a first groove 143 and a second surface 144 having a second groove 145. The first and second grooves 143 and 145 receive the first and second aligning pins 173 and 174, respectively. An upper surface 146 and a lower surface 147 are defined between the first and second surfaces 142 and 144. The first and second grooves 143 and 145 preferably extend from the upper surface 146 of the cam member 141 and end above the lower surface 147, as shown in FIG. 20. Preferably, the upper surface 146 is a convex surface, as shown in FIG. 22. A first post 148 and a second post 149 are disposed in the lower surface 147 and receive the first and second spring members 151 and 153, respectively.

Figure 30:
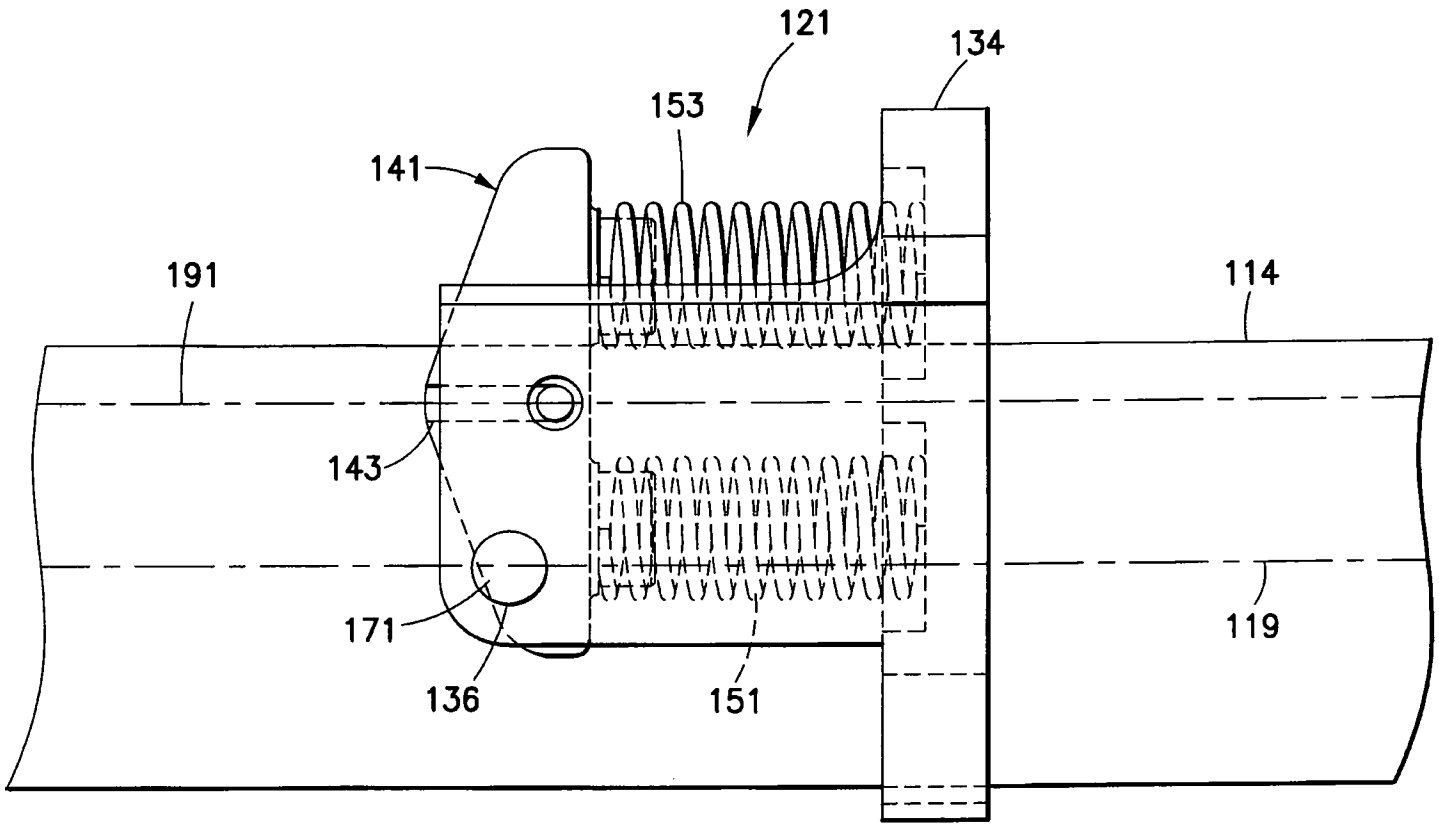
FIG. 30 is an enlarged, partial side elevational view of the resistance device of FIG. 29 with one of the switch blades removed.

As shown in FIG. 22, the first openings 135 and 137 are offset from a longitudinal axis 119 of the grooves 143 and 145, as shown in FIGS. 20, 21 and 30.

The first spring member 151 has a first end 152 disposed in the first opening 183 in the base 134 of the housing 131. A second end 154 of the first spring member 151 is received by a first post 148 of the cam member 141. The second spring member 153 has a first end 155 disposed in the second opening 184 in the base 134 of the housing 131. A second end 156 of the second spring member 153 is received by the second post 149 of the cam member 141. The first and second spring members 151 and 153 allow the cam member 141 to move with respect to the housing 131. The aligning pins 173 and 174 received in the grooves 143 and 145 of the cam member 141 guide movement of the cam member 141 with respect to the housing 131.

Figure 29:
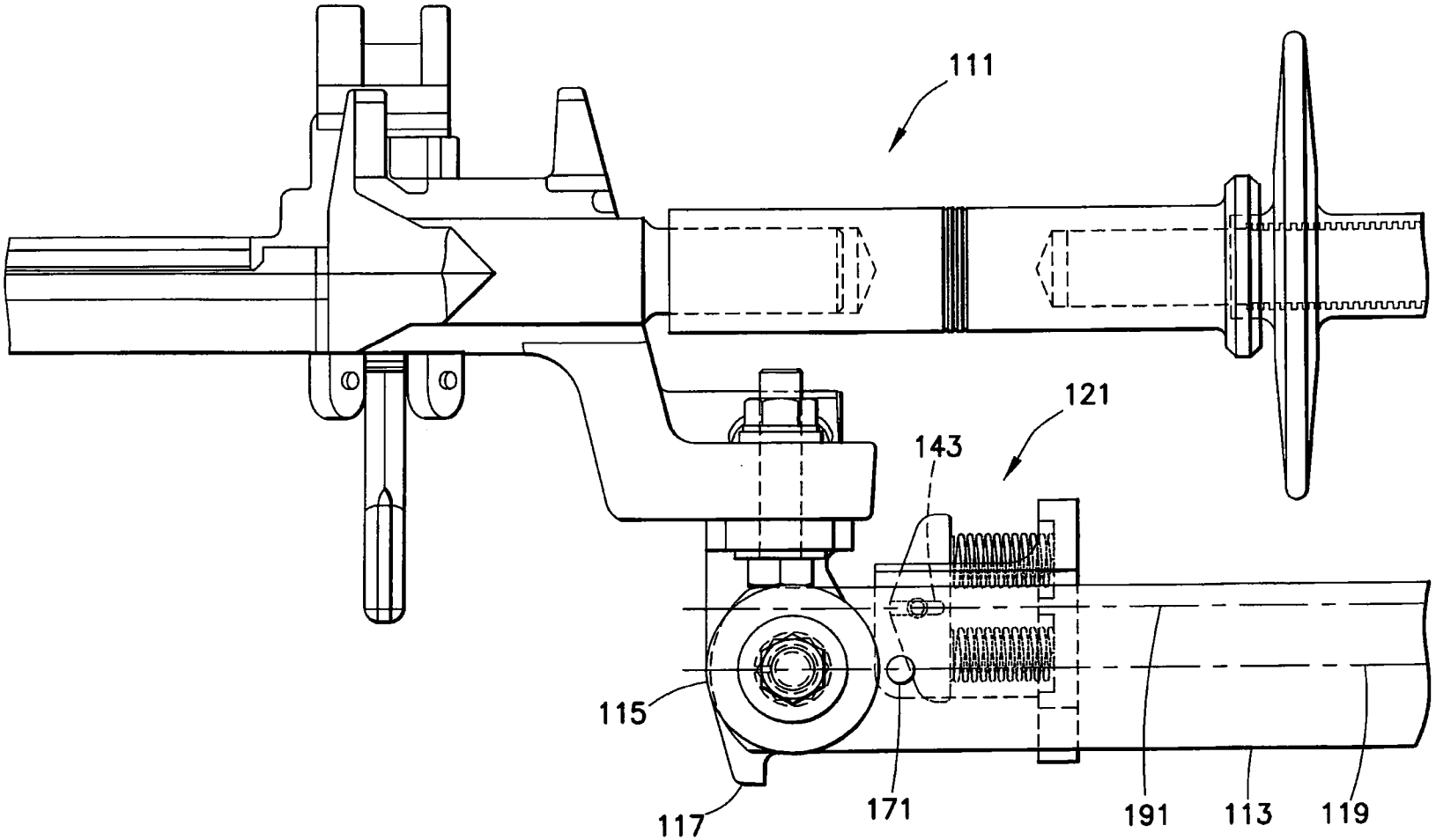
FIG. 29 is an enlarged, partial side elevational view showing the cam groove offset from the center line of the switch blades.

Operation of the resistance device 121 according to a second exemplary embodiment is substantially identical to that of the first exemplary embodiment. However, the resistance device 121 is connected to the conductive blades 113 and 114 such that the aligning pins 173 and 174 are offset from the center line 119 of the blades. Accordingly, the cam member grooves 143 and 145 are also offset from the center line 119 of the blades. Thus, as shown in FIGS. 29 and 30, a center line 191 of the cam member grooves 143 and 145 is offset from a center line 119 of the blades 113 and 114.

Figure 24:
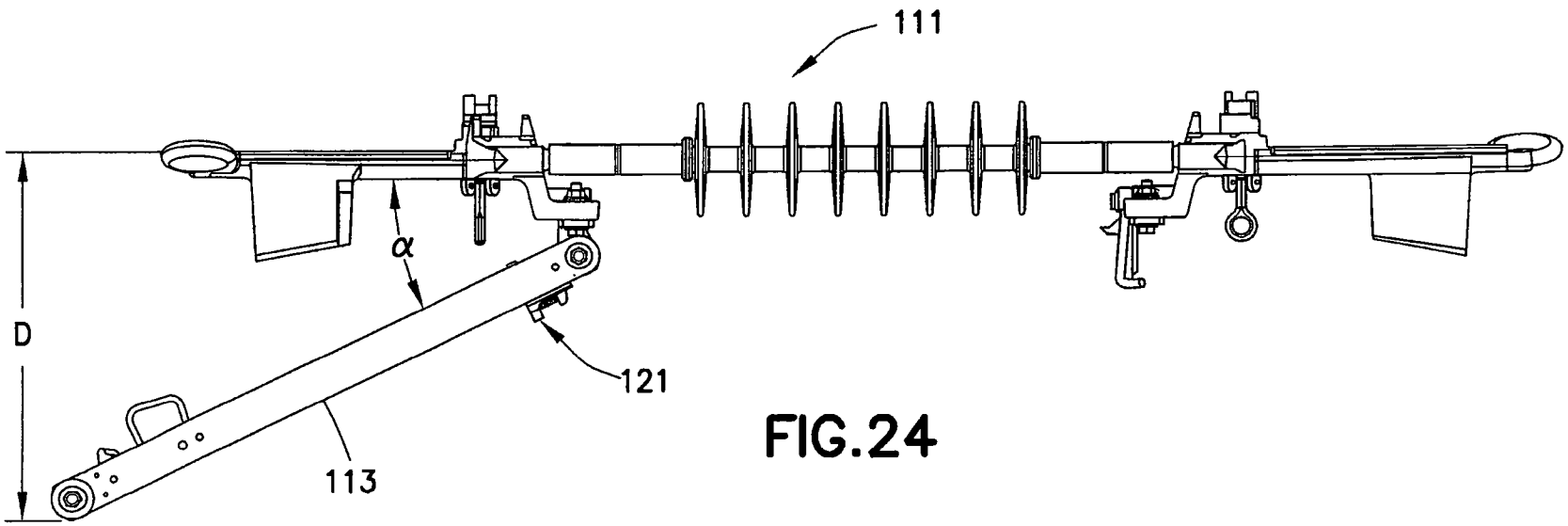
FIG. 24 is a side elevational view of the switch assembly of FIG. 23 in a fully opened position.
Figure 25:
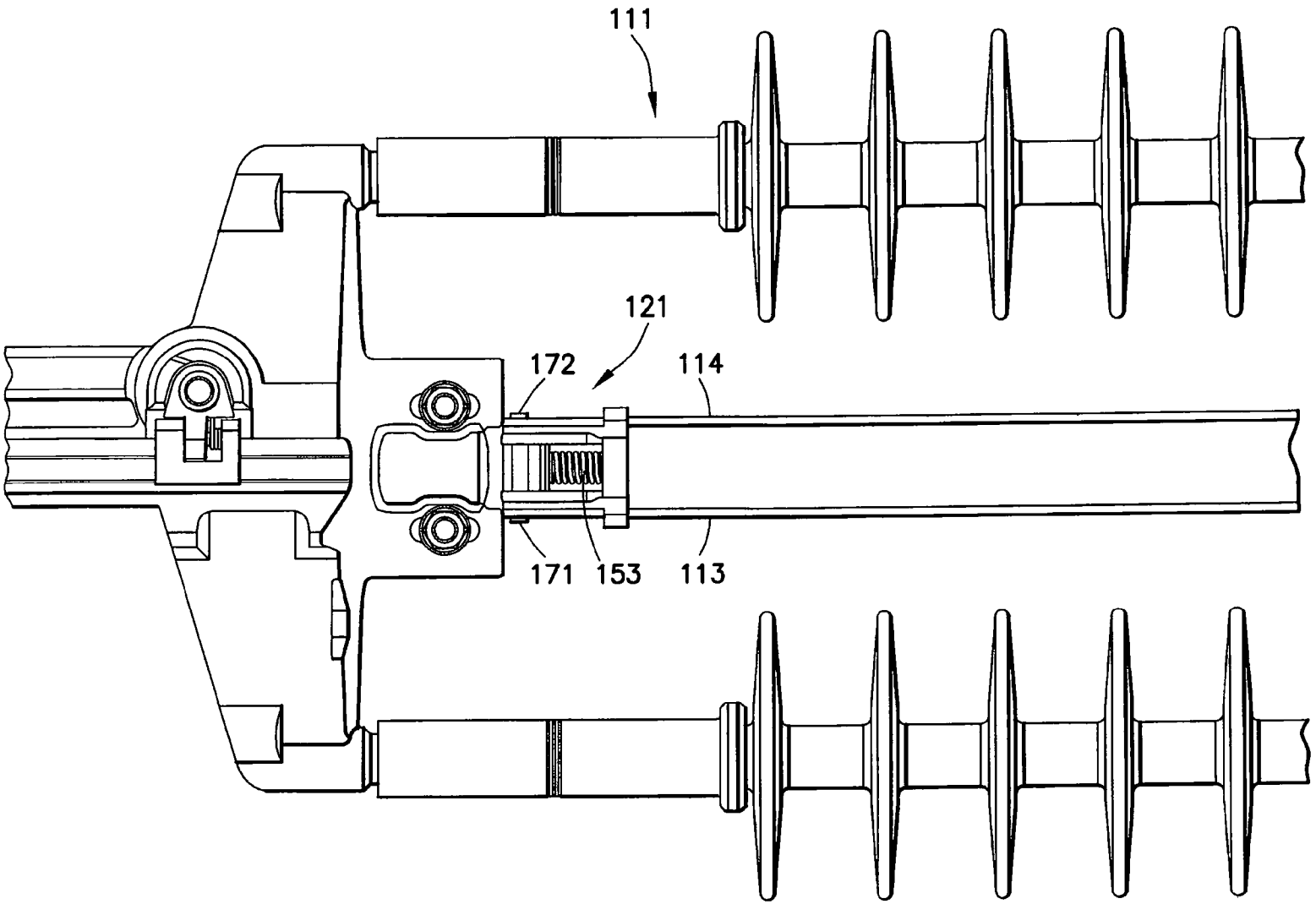
FIG. 25 is a partial top plan view of the fully closed switch assembly of FIG. 23.
Figure 26:
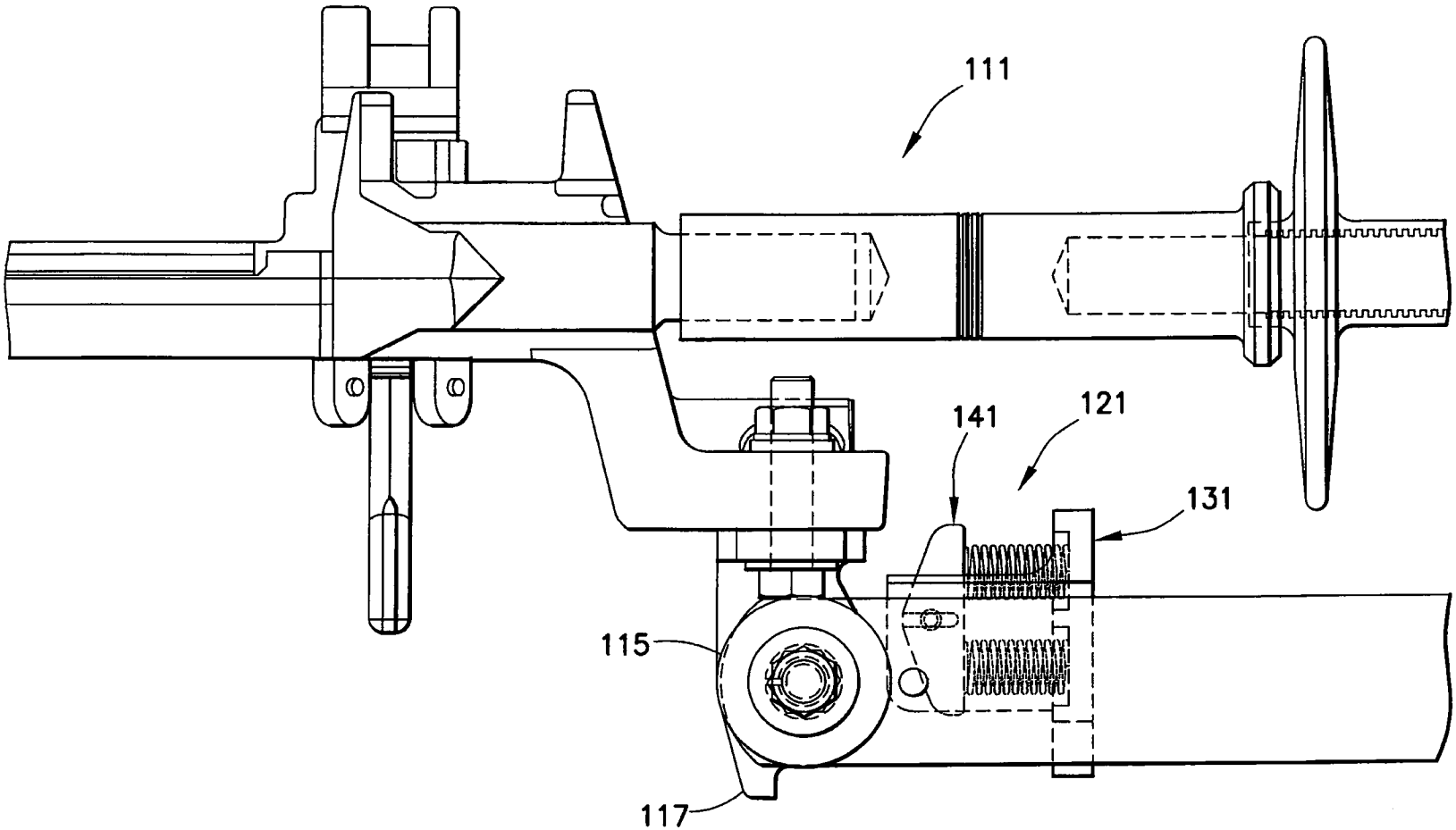
FIG. 26 is an enlarged, partial side elevational view in partial cross section of the fully closed switch assembly of FIG. 23.
Figure 27:
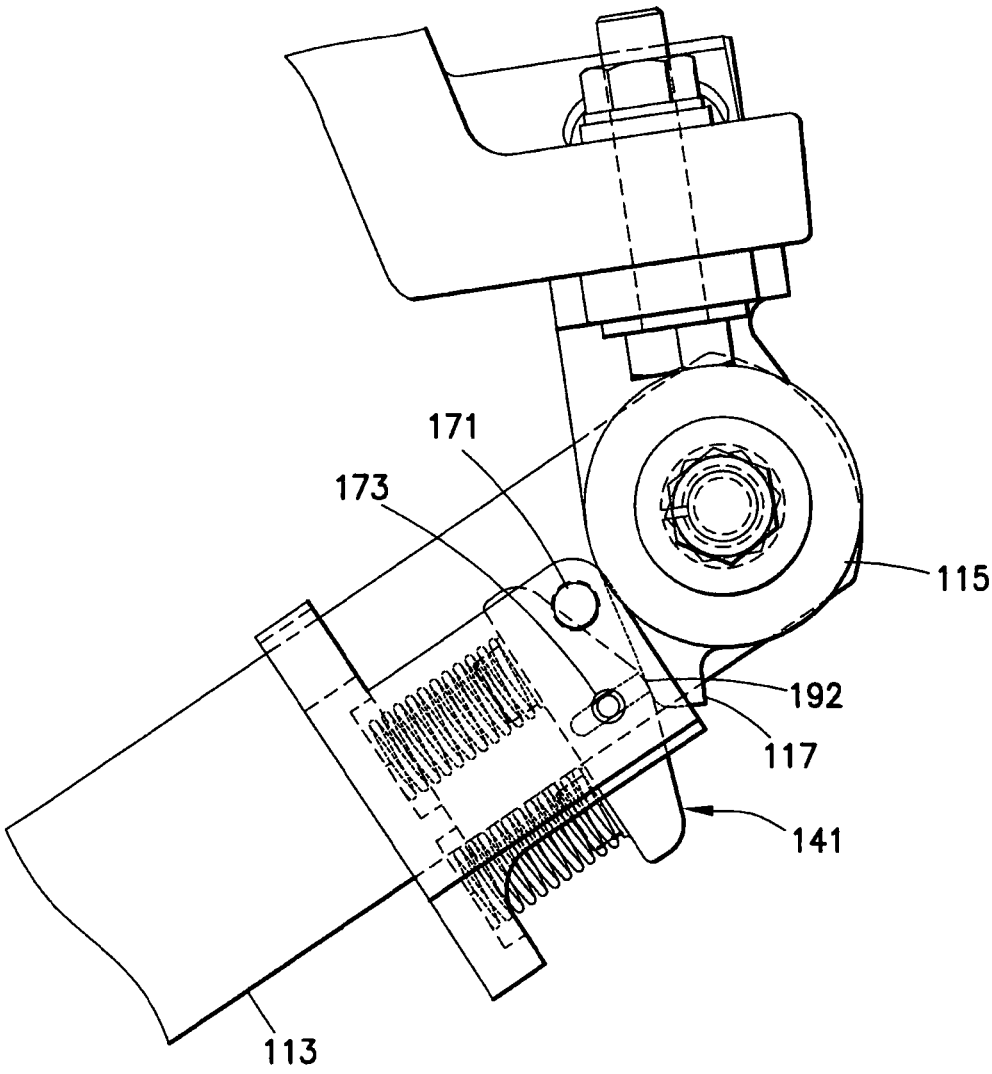
FIG. 27 is an enlarged, partial side elevational view in partial cross section of the fully opened switch assembly of FIG. 24.
Figure 28:
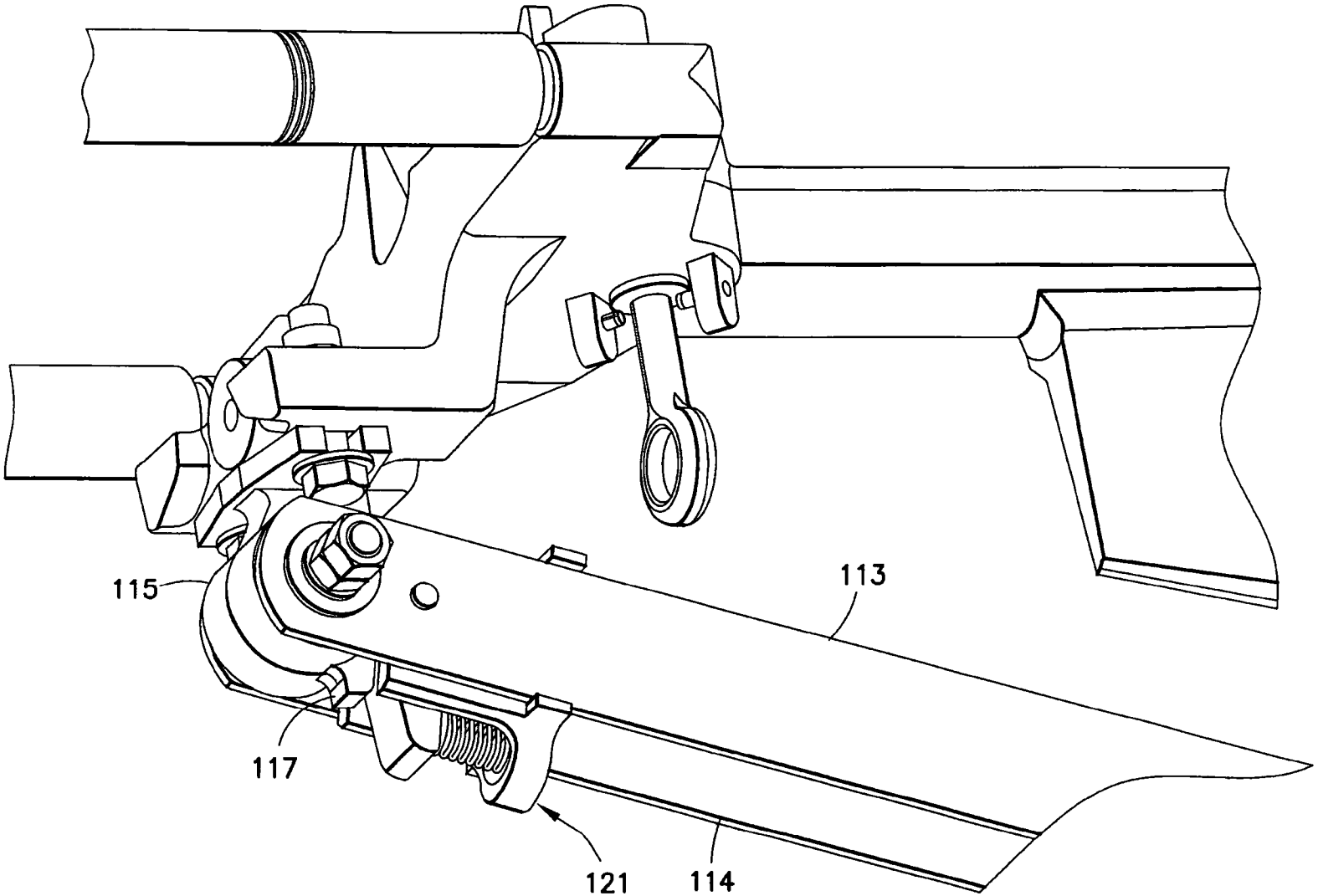
FIG. 28 is a partial perspective view of the fully opened switch assembly of FIG. 23.

As shown in FIG. 24, the conductive blades 113 and 114 are in the fully open position. A specified arcing distance "D" and a reference angle "a" are required to prevent arcing between the parallel lines when the switch is opened. When the distance "D" is less than the required distance, arcing can occur when the switch is opened. By offsetting the cam grooves from the center line of the blades 113, the high point 192 of the cam member 141 contacts the mounting hinge tab (instead of the mounting hinge 115) such that the distance "D" is larger, thereby preventing arcing.

Third Exemplary Embodiment

FIGS. 31-40 show a resistance device 221 according to a third exemplary embodiment of the present invention. The resistance device 221 of the third exemplary embodiment is substantially similar to the resistance device 121 of the second exemplary embodiment. The resistance device 221 is connected between two conductive blades 113 and 114 of the switch assembly 111 (FIGS. 23-30). The resistance device 221 includes a housing 231 connected to the blades 113 and 114, and a cam member 241 movably connected to the housing 231.

Figure 31:
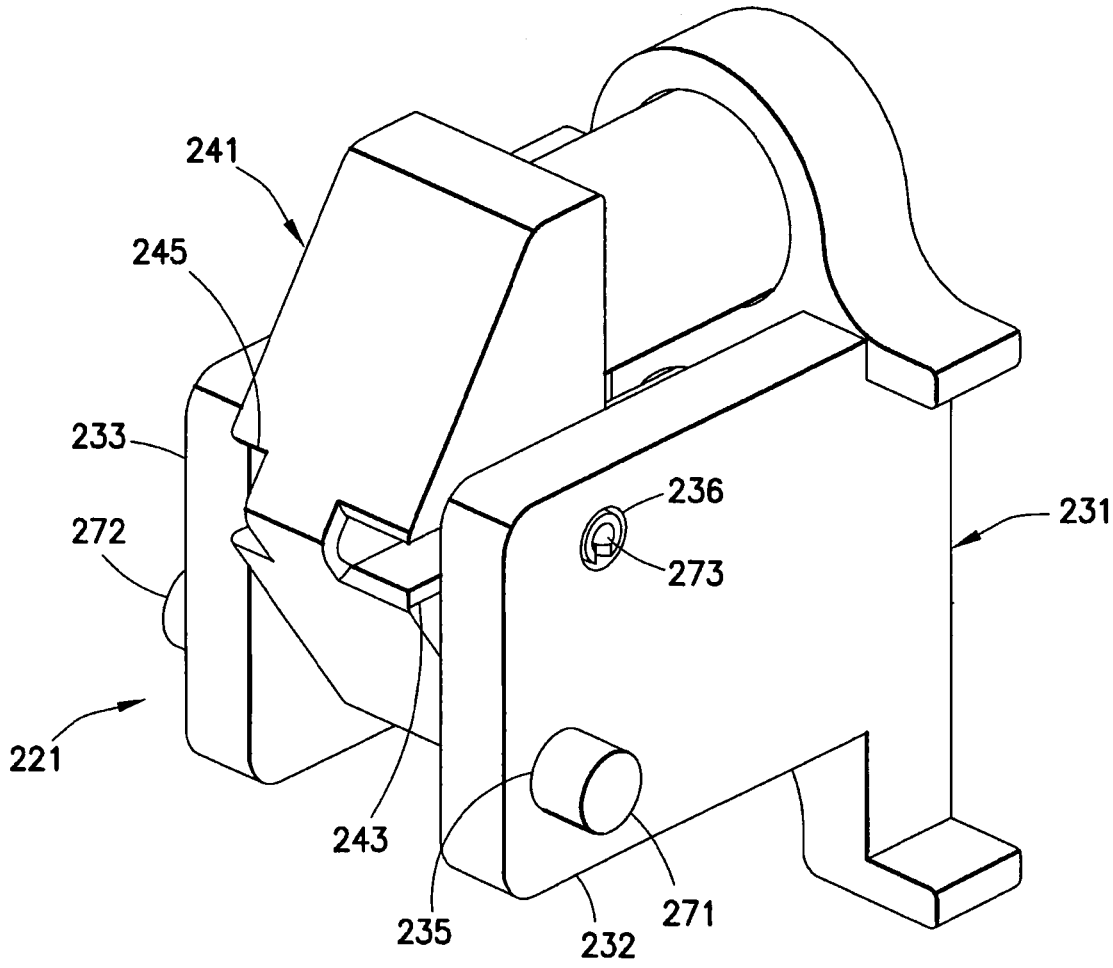
FIG. 31 is a perspective view of a resistance device according to a third exemplary embodiment of the present invention.
Figure 32:
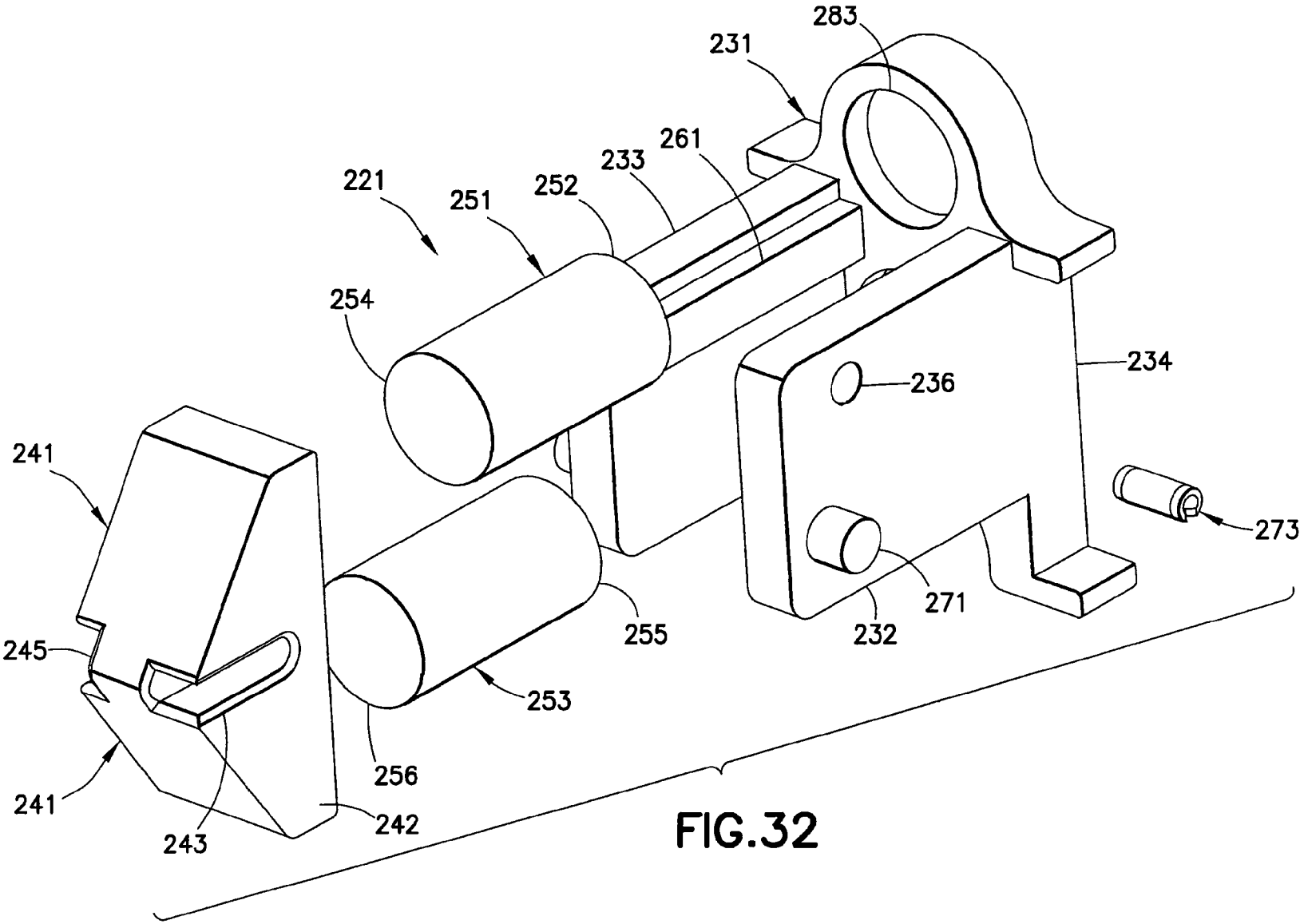
FIG. 32 is an exploded perspective view of the resistance device of FIG. 31.

The housing 231, as shown in FIGS. 31, 32 and 36-40, has first and second supporting brackets 232 and 233 extending upwardly from a base 234. Preferably, the housing 231 has retaining pins 271 and 272 that are unitarily formed with the housing as a one-piece member. Alternatively, each of the first supporting bracket 232 and the second supporting bracket 233 has a first opening 235 and 237 for receiving the retaining pins 271 and 272, such as by press-fit, for securing the housing to the blades 113 and 114. Preferably, the first openings 235 and 237 do not extend entirely through the first and second supporting brackets 232 and 233, as shown in FIGS. 31 and 32. Each of the first and second supporting brackets 232 and 233 has a second opening 236 and 238 for receiving aligning pins 273 and 274, such as by press-fit, for engaging the cam member 241. As shown in FIGS. 31 and 32, preferably the second openings 36 and 38 extend entirely through the first and second supporting brackets 232 and 233.

A first groove 281 is formed in the base 234 of the housing 231 and is adapted to receive a blade 113. A second groove 282 is formed in the base 234 and is adapted to receive the other blade 114. The first and second grooves 281 and 282 in the base 234 and the retaining pins 271 and 272 facilitate rigidly connecting the housing 231 to the blades 113 and 114, and substantially prevent movement of the housing during operation of the blades. A first opening 283 and a second opening 284 are disposed in the base 234 and receive the first and second spring members 251 and 253, respectively.

Figure 37:
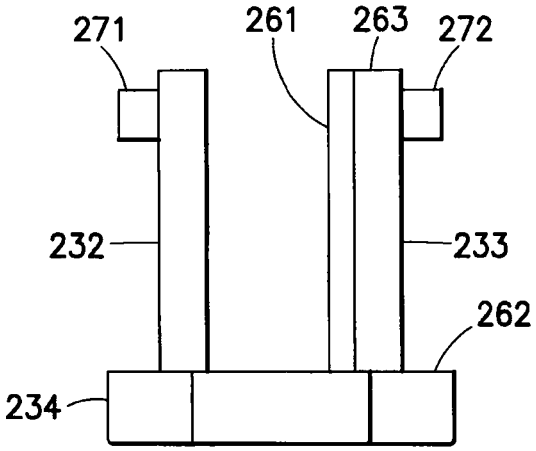
FIG. 37 is a front elevational view of the housing of FIG. 36.
Figure 38:
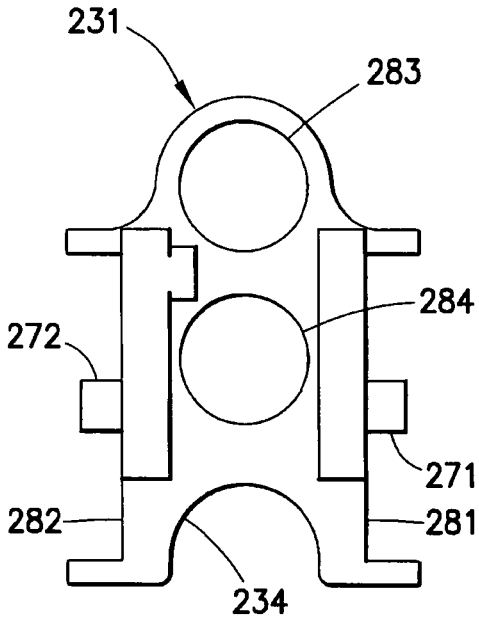
FIG. 38 is a top plan view of the housing of FIG. 36.
Figure 39:
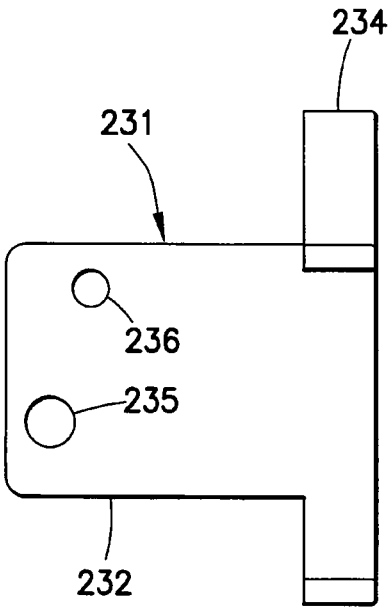
FIG. 39 is a side elevational view of the housing of FIG. 36.
Figure 40:
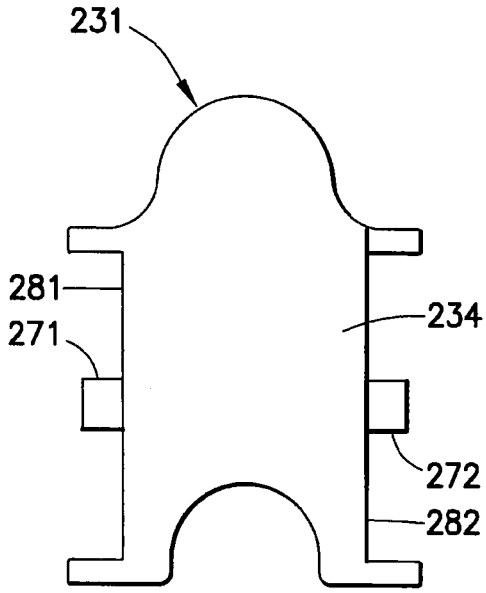
FIG. 40 is a bottom plan view of the housing of FIG. 36.

A protrusion 261 extends outwardly from the second supporting bracket 233. Preferably, the protrusion 261 extends between an upper surface 262 of the base 234 of housing 231 and an upper surface 263 of the second supporting bracket 233, as shown in FIG. 37. Preferably, the protrusion 261 is substantially rectangular.

Figure 33:
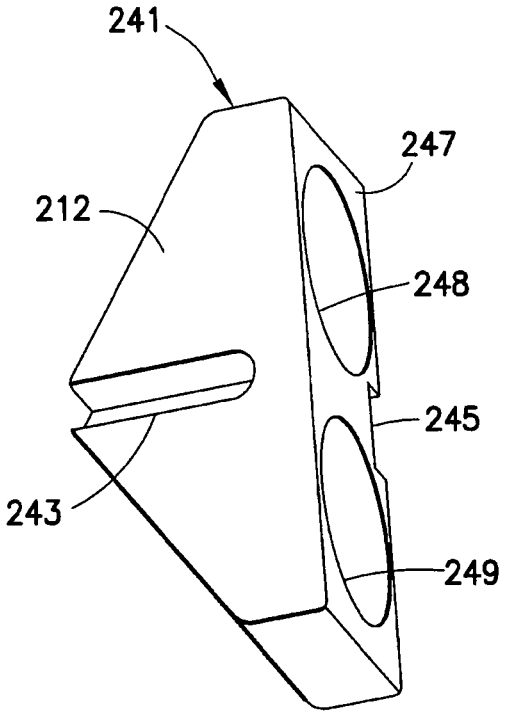
FIG. 33 is a perspective view of a cam member of the resistance device of FIG. 31.
Figure 34:
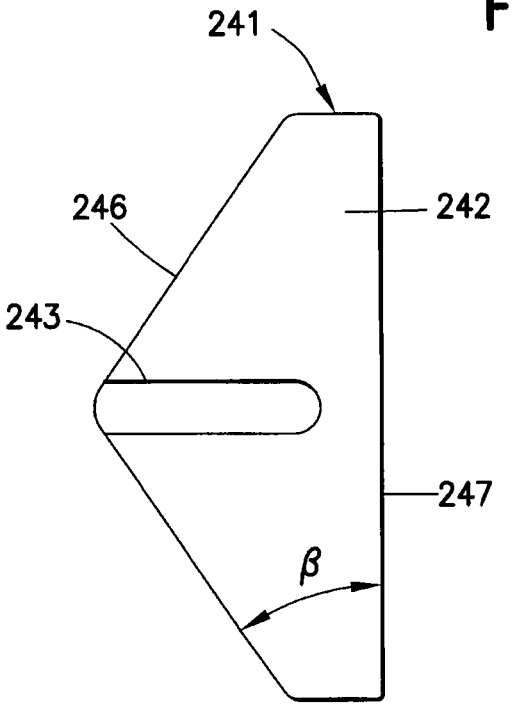
FIG. 34 is a side elevational view of the cam member of FIG. 33.
Figure 35:
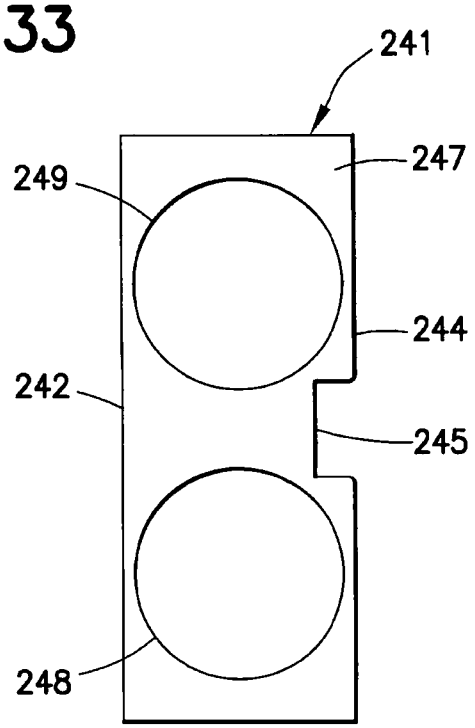
FIG. 35 is a bottom plan view of the cam member of FIG. 33.
Figure 36:
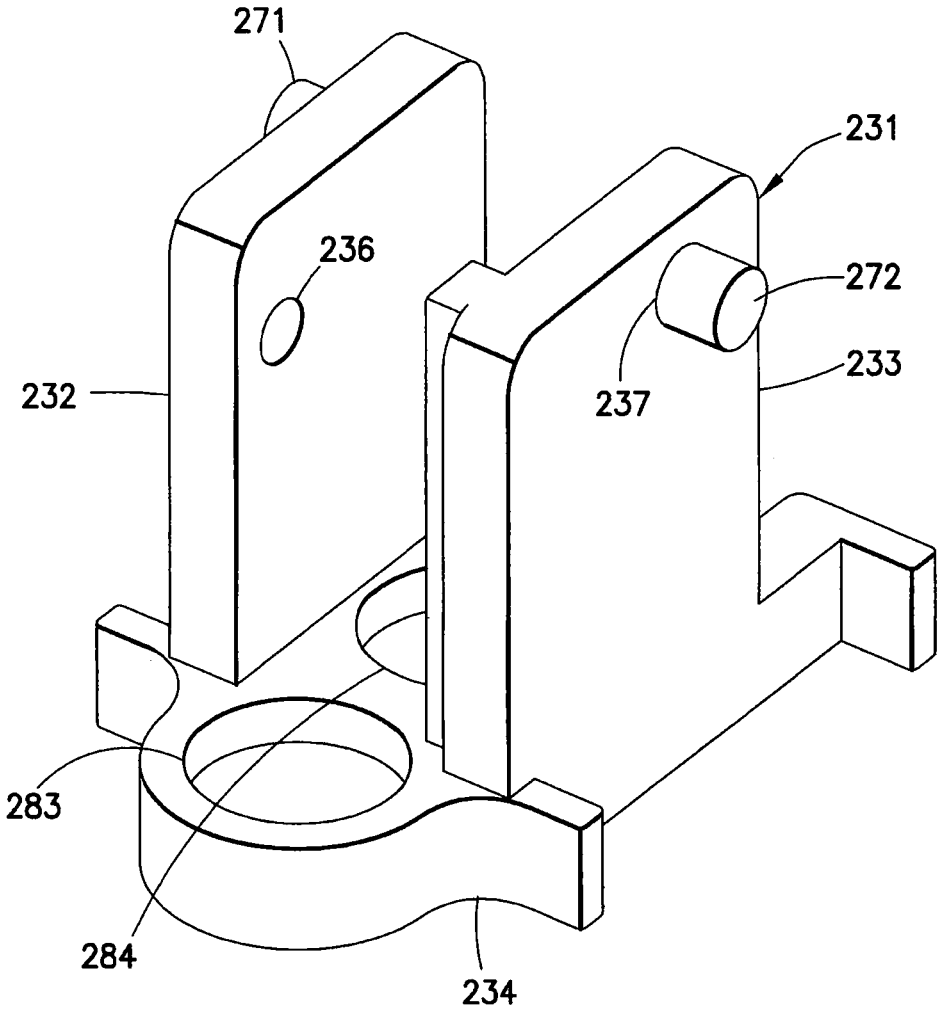
FIG. 36 is a perspective view of a housing of the resistance device of FIG. 31.

The cam member 241, as shown in FIGS. 31-35, is movably connected between the two support brackets 232 and 233 of the housing 231. The cam member 241 has a first surface 242 having a first groove 243 and a second surface 244 having a second groove 245. The first groove 243 receives the aligning pin 273 and the second groove 245 receives the protrusion 261. An upper surface 246 and a lower surface 247 are defined between the first and second surfaces 242 and 244. The first groove 243 preferably extends from the upper surface 246 of the cam member 241 and ends above the lower surface 247, as shown in FIGS. 32 and 34. The second groove 245 preferably extends from the upper surface 246 to the lower surface 247, as shown in FIGS. 32, 33 and 35. Preferably, the upper surface 246 is a convex surface, as shown in FIG. 34. A first opening 248 and a second opening 249 are disposed in the lower surface 247 and receive the first and second spring members 251 and 253, respectively. Preferably, the first groove 243 extends from the upper surface 246 toward the lower surface 247, as shown in FIG. 34. The second groove 245 preferably extends from the upper surface 246 to the lower surface 247, as shown in FIGS. 32 and 35. Preferably, an angle β formed between the upper surface 246 and the lower surface 247 of the cam member 241 does not exceed approximately forty-five degrees, and is preferably approximately thirty-four degrees.

As shown in FIG. 31, the first openings 235 and 237 are offset from a longitudinal axis of the grooves 243 and 245.

The first spring member 251 has a first end 252 disposed in the first opening 283 in the base 234 of the housing 231. A second end 254 of the first spring member 251 is received by a first opening 248 of the cam member 241. The second spring member 253 has a first end 255 disposed in the second opening 284 in the base 234 of the housing 231. A second end 256 of the second spring member 253 is received by the second opening 249 of the cam member 241. The first and second spring members 251 and 253 allow the cam member 241 to move with respect to the housing 231. The aligning pin 273 and the protrusion 261 received in the grooves 243 and 245, respectively, of the cam member 241 guide movement of the cam member 241 with respect to the housing 231. Preferably, the first and second spring members 251 and 253 are substantially cylindrical, as shown in FIG. 32. Preferably, the first and second spring members 251 and 253 are made of a resilient material, such as rubber or polyurethane, and preferably the resilient material has a durometer of approximately 80.

Operation of the resistance device 221 according to the third exemplary embodiment is substantially identical to that of the first and second exemplary embodiments. However, the resistance device 221 is connected to the conductive blades 113 and 114 such that the aligning pin 273 and the protrusion 261 are offset from the center line 119 of the blades. Accordingly, the cam member grooves 243 and 245 are also offset from the center line 119 of the blades. Thus, as shown in FIGS. 29 and 30, a center line 191 of the cam member grooves 143 and 145 is offset from a center line 119 of the blades 113 and 114.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims.

What is claimed is:

1. A resistance device for an electrical switch assembly, comprising:

a housing having a base and first and second supporting brackets extending outwardly therefrom, first and second blades of the electrical switch assembly being receivable in said base;

a cam member movably connected to said first and second supporting brackets; and first and second spring members connected between said base and said cam member, said first and second spring members biasing said cam member away from said base.

2. The resistance device for an electrical switch assembly according to claim 1, wherein first and second retaining pins connected to said first and second supporting brackets secure the first and second blades to said housing.

3. The resistance device for an electrical switch assembly according to claim 1, wherein first and second grooves are formed in said cam member; and first and second groove members connected to said first and second supporting brackets are received by said first and second grooves such that movement of said cam member is guided by said first and second groove members disposed in said first and second grooves.

4. The resistance device for an electrical switch assembly according to claim 3, wherein said first and second groove members are first and second aligning pins received by first and second aligning holes in said first and second supporting brackets.

5. The resistance device for an electrical switch assembly according to claim 3, wherein said first groove member is an aligning pin received by an aligning hole in said first supporting bracket, and said second groove member is a projection extending along said second supporting bracket.

6. The resistance device for an electrical switch assembly according to claim 3, wherein said first and second grooves are centered with respect to a longitudinal axis of the first and second blades.

7. The resistance device for an electrical switch assembly according to claim 3, wherein said first and second grooves are offset from a longitudinal axis of the first and second blades.

8. The resistance device for an electrical switch assembly according to claim 1, wherein said first and second spring members are coil springs.

9. The resistance device for an electrical switch assembly according to claim 1, wherein said first and second spring members have a substantially cylindrical shape.

10. The resistance device for an electrical switch assembly according to claim 4, wherein said first and second cam grooves extend from an upper surface of said cam member and end above a lower surface of said cam member.

11. The resistance device for an electrical switch assembly according to claim 5, wherein said first cam groove extends from an upper surface of said cam member and ends above a lower surface of said cam member, and said second cam groove extends from said upper surface to said lower surface of said cam member.

12. An electrical switch assembly, comprising:

a mounting hinge;

first and second conductive blades rotatably connected to said mounting hinge and rotatable between open and closed positions;

a tab connected to said mounting hinge; and a resistance device disposed between said first and second conductive blades including a housing having a base and first and second supporting brackets extending outwardly therefrom, said base receiving said first and second conductive blades of said electrical switch assembly;

a cam member movably connected to said first and second supporting brackets; and first and second spring members connected between said base and said cam member, said cam member engaging said tab and compressing said first and second spring members during rotation of said first and second conductive blades from said open position toward said closed position to increase a force required to rotate said conductive blades, said first and second spring members biasing said cam member away from said base.

13. The electrical switch assembly according to claim 12, wherein a maximum travel distance of said cam member is when said pair of conductive blades are between approximately 90 and 120 degrees inclusive relative to said closed position.

14. The electrical switch assembly according to claim 13, wherein said maximum travel distance of said cam member is at approximately 115 degrees.

15. The electrical switch assembly according to claim 12, wherein first and second grooves are formed in said cam member; and first and second groove members connected to said first and second supporting brackets are received by said first and second grooves such that movement of said cam member is guided by said first and second groove members disposed in said first and second grooves.

16. The resistance device for an electrical switch assembly according to claim 15, wherein said first and second grooves are centered with respect to a longitudinal axis of said first and second conductive blades.

17. The electrical switch assembly according to claim 12, wherein an angle between an upper surface and a lower surface of said cam member does not exceed approximately 45 degrees.

18. A method of closing an electrical switch assembly, comprising the steps of rotating a conductive blade about a mounting hinge from a fully open position in which a resistance member connected to the conductive blade is not engaged with a tab connected to the mounting hinge; and engaging the resistance member connected to the conductive blade with the tab connected to the mounting hinge to increase a force required to rotate the conductive blade to a closed position when moving the conductive blade to the closed position, thereby substantially preventing accidental movement of the conductive blade to the closed position.

19. A method of closing an electrical switch assembly according to claim 18, wherein a spring member of the resistance member is compressed when the conductive blade is in the fully open position to increase the force required to move the conductive blade out of the fully open position.

20. A method of operating an electrical switch assembly according to claim 19, wherein a force created by the resistance device is greatest when the conductive blade is between approximately 90 and 120 degrees inclusive relative to the closed position.

* * * * *